US006112481A

United States Patent [19]

Schiedegger et al.

[11] Patent Number: 6,112,481

[45] Date of Patent: Sep. 5, 2000

[54] DOOR SURROUND APPARATUS AND METHOD OF ASSEMBLY

[75] Inventors: Charles E. Schiedegger, Metamora; J. Richard Logan, Oxford; Richard J. MacLeod, Brighton; Aundrea Nurenberg, Brown City; Michael C. Clark, Columbiaville; Clyde G. Allen, North Branch, all of Mich.

[73] Assignee: Tapco International, Plymouth, Mich.

[21] Appl. No.: 08/969,257

[22] Filed: Nov. 13, 1997

Related U.S. Application Data

[63] Continuation-in-part of application No. 08/770,396, Dec. 20, 1996, abandoned, which is a continuation-in-part of application No. 08/379,716, Jan. 27, 1995, abandoned.

[51] Int. Cl.[7] ..... E04F 19/02

[52] U.S. Cl. ..... 52/211; 52/212; 52/204.53; 52/204.54; 52/288.1; 52/717.01; 52/717.05; 52/718.04; 52/716.2

[58] Field of Search ..... 52/211, 212, 208, 52/204.53, 204.54, 287.1, 288.1, 656.4, 656.5, 656.6, 717.01, 718.01, 718.02, 718.03, 718.04, 718.05, 718.06, 717.03, 717.05, 716.2

[56] References Cited

U.S. PATENT DOCUMENTS

| | | | |
|---|---|---|---|
| 346,187 | 7/1886 | Boda . | |
| 385,233 | 6/1888 | Boda . | |
| 866,479 | 9/1907 | Kiesel, Jr. | 52/288.1 X |
| 1,150,790 | 8/1915 | Swanson . | |
| 1,229,765 | 6/1917 | Lehman . | |
| 1,424,658 | 8/1922 | Lidstone | 52/718.02 X |
| 1,426,277 | 8/1922 | Conant | 52/718.02 X |
| 3,139,703 | 7/1964 | Hilt | 52/211 X |
| 3,295,277 | 1/1967 | Potter et al. | 52/204.53 |
| 3,449,873 | 6/1969 | Damato et al. . | |
| 3,609,928 | 10/1971 | Mock | 52/211 X |
| 3,750,728 | 8/1973 | Stark . | |
| 3,778,945 | 12/1973 | Medow . | |
| 3,974,606 | 8/1976 | LaBorde | 52/288.1 |
| 4,000,597 | 1/1977 | Burton | 52/716.1 |
| 4,228,630 | 10/1980 | Englert et al. . | |
| 4,423,575 | 1/1984 | Lagergren et al. | 52/204.53 |
| 4,608,800 | 9/1986 | Fredette . | |
| 4,803,815 | 2/1989 | Bürgers . | |
| 5,199,237 | 4/1993 | Juntunen . | |
| 5,222,343 | 6/1993 | Anderson | 52/718.04 |
| 5,274,972 | 1/1994 | Hansen | 52/287.1 X |
| 5,426,901 | 6/1995 | Indracek . | |
| 5,444,954 | 8/1995 | Anderson . | |
| 5,551,201 | 9/1996 | Anderson | 52/287.1 X |
| 5,564,233 | 10/1996 | Norton | 52/287.1 X |
| 5,579,617 | 12/1996 | Schiedegger et al. . | |
| 5,581,970 | 12/1996 | O'Shea . | |
| 5,625,992 | 5/1997 | Strick et al. . | |

FOREIGN PATENT DOCUMENTS

| | | | |
|---|---|---|---|
| 679523 | 10/1966 | Belgium | 52/287.1 |
| 2557057 | 6/1977 | Germany . | |
| 4138207 | 12/1992 | Germany . | |

OTHER PUBLICATIONS

"Design Master™ Door Surround—Interior Molding & Exterior Accents", Mid–America.

Building Products Corporation Brochure, p. 4, 1994.

"Selectrim™ Applications", The James Wood Company Brochure, 1991.

*Primary Examiner*—Laura A. Callo

*Attorney, Agent, or Firm*—Howard & Howard

[57] ABSTRACT

A surround molding assembly for a doorway or window of a structure includes a pair of vertical molding members releasably secured by independent hanger strips along vertical sides of a doorway. The hanger strips include securing portions which releasably engage with securing portions of the vertical molding members to eliminate the need for nails, screws or the like. A mantle molding member is provided and fixedly secured over a top portion of the doorway without the need for external fastening elements. An internal corner member is positioned adjacent each end of the mantle molding member to direct water away from the doorway. In another embodiment a header assembly is disclosed which is adapted to be secured to an uneven exterior surface of a structure such as aluminum or vinyl siding.

16 Claims, 19 Drawing Sheets

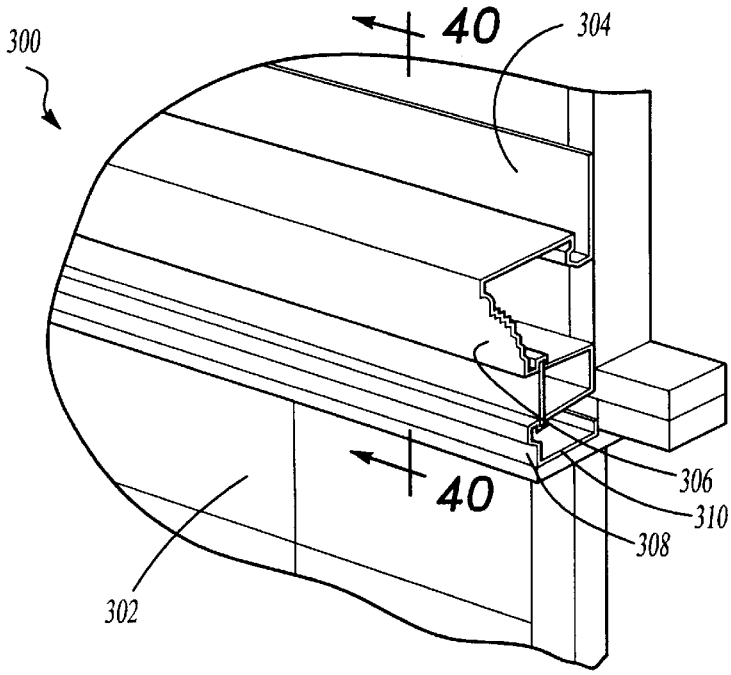
Fig-39
Fig-40
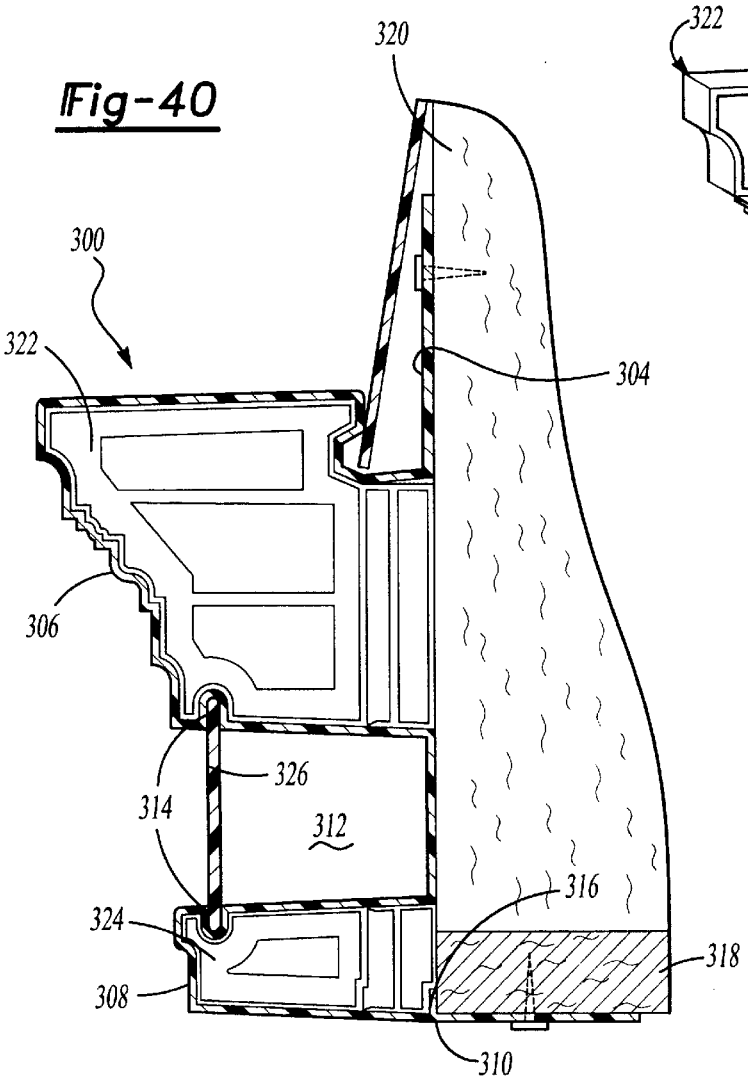
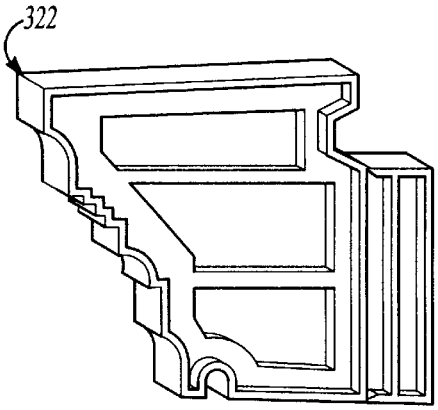
Fig-41
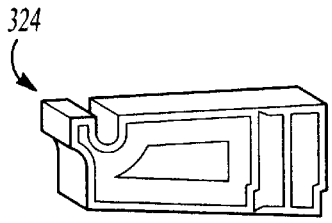
Fig-42

DOOR SURROUND APPARATUS AND METHOD OF ASSEMBLY

CROSS REFERENCE TO RELATED APPLICATIONS

This application is a continuation-in-part of U.S. Ser. No. 08/770,396 filed Dec. 20, 1996 now abandoned which is a continuation-in-part of U.S. Ser. No. 08/379,716, filed Jan. 27, 1995 now abandoned.

BACKGROUND OF THE INVENTION

1. Technical Field

This invention relates to decorative molding assemblies for framing doorways or windows of residential or commercial structures, and more particularly to a decorative surround molding apparatus for decoratively framing a doorway, window, garage door opening, etc. of a residential or commercial structure.

2. Discussion

Molding assemblies are used in a variety of applications to frame or "surround" doorways, windows, patio doors, garage doors etc., to thus provide a decorative, aesthetically appealing framing for such doorways, windows or areas of a structure. In recent years, these surround molding assemblies have been manufactured from plastics such as high-density polyurethane. In general, plastics provide significant advantages over natural wood. For example, door surround molding assemblies or components thereof manufactured from plastic are low in maintenance when compared with natural wood molding assemblies. Plastic molding assemblies are not susceptible to moisture and therefore will not decay, warp or splinter like natural wood. Advantageously, plastic surround molding assemblies or components thereof can be sawed, drilled, glued or nailed just like natural wood. Still further, during the manufacture of plastic molding assemblies, plastic can be tinted with dyes or other materials to provide molding assembly components which are of desired colors, thus obviating the need for painting prior or subsequent to installation on a structure.

Prior developed door surround molding assemblies have typically required the various components comprising the assembly to be secured directly to the structure via nails, threaded fasteners or other like securing implements. Most typically, the various components have been provided with one or more flanges including a plurality of apertures through which the nails or other like fastening elements are driven to secure each molding sub-component to the structure. While generally effective in securing the various door surround molding components to the structure, the requirement that nails or other like threaded fastening elements be used can sometimes add to the time and expense associated with installing the complete surround molding assembly. Once installed, should one component of the surround molding assembly need to be removed or replaced, the use of threaded fasteners or nails can sometimes complicate the task of removing and replacing the sub-components of the molding assembly.

Accordingly, it is a principal object of the present invention to provide a surround molding assembly for a doorway, window or other portion of a building to provide a decorative and aesthetically pleasing appearance, while enabling one or more sub-components of the molding assembly to be secured to the structure in a secure, yet releasable fashion, without the need for a large plurality of nails or threaded fasteners to be employed.

It is yet another object of the present invention to provide a surround molding assembly for a doorway, window, archway or other portion of a structure which provides a decorative, aesthetically pleasing appearance, and in which each of the components of the surround assembly include one or more securing portions adapted to releasably engage with one or more hanger members fixedly secured to the structure. In this manner, the decorative molding components of the assembly could be securely, yet releasably held to the structure, without the use of a large plurality of nails, threaded fasteners or other like fastening elements.

It is still another object of the present invention to provide a surround molding assembly adapted to be secured to a structure to surround a doorway, window, archway, etc., where the apparatus includes a pair of vertical molding members each including a securing portion which is releasably securable to a hanger member fixedly secured along vertical portions of the doorway or window, and an independent mantle molding member having a securing portion which is releasably securable to a hanger member secured to the structure.

SUMMARY OF THE INVENTION

The above and other objects are provided by a door surround molding apparatus and method of assembly in accordance with preferred embodiments of the present invention. The door surround molding apparatus, in one preferred embodiment, comprises at least one vertical molding member which is positioned closely adjacent a vertical portion of a doorway or window, and an associated hanger strip which is fixedly secured to the structure closely adjacent the vertical portion. The vertical molding member includes a securing portion which is engageable with its associated hanger member to enable the vertical molding member to be releasably secured to the structure without the use of nails or threaded fasteners extending through any portion of the vertical molding member itself.

The above-described preferred embodiment of the apparatus further includes a mantle molding member having a length sufficient to extend at least partially over, and preferably completely over, the doorway or window. The mantle molding member also includes a securing portion which engages with a mantle hanger member fixedly secured to the structure over at least a portion of the doorway or window. The securing portion of the mantle molding member is releasably engageable with the mantle hanger member to thereby allow the mantle molding member to be at least partially secured to the structure by the mantle hanger member. In this manner, the assembly of the vertical molding members and mantle molding member are simplified considerably through the reduction in the number of nails or threaded fasteners which must be used to effect assembly of these components to the structure.

In the preferred embodiment described above, the apparatus further preferably includes an upper corner member associated with each one of the vertical molding members which is used to provide an aesthetically appealing interface or connection between upper terminal end portions of each of the vertical molding members and the terminal, lengthwise end portions of the mantle molding member. In this manner, the upper corner members, when fixedly secured to the structure, provide the molding apparatus with a decorative, continuous-looking appearance which surrounds the doorway or window without any gaps or discontinuities between the various components of the apparatus which detract from the overall aesthetically pleasing appearance provided by the apparatus.

In the preferred embodiment described above, a pair of decorative base molding members are further preferably included for covering lower terminal end portions of each of the vertical molding members. The decorative base molding members thus provide an aesthetically appealing means for terminating the lower terminal end portions of the vertical molding members without significantly complicating the assembly of the overall molding surround apparatus.

In an alternative preferred embodiment of the present invention a molding member is disclosed which incorporates an enlarged lip portion extending along at least a major portion of the overall length of the molding member opposite longitudinal edges of the molding member. An alternative preferred embodiment of the hanger member is also disclosed which incorporates a pair of semi-circular channels adapted to receive the enlarged lip portions of the molding member when the molding member is secured to the hanger member. The hanger member further includes a plurality of upstanding support portions for providing support to the molding member such that the molding member will not readily flex if pressure is exerted against it after it is installed to the hanger member. To aid in installing the hanger member, an installation tool is also disclosed which permits the hanger member to be secured to the exterior surface of a building in a precise orientation.

Also disclosed are upper and lower installation supports adapted to be inserted within portions of a mantle molding member to provide support to the outer surfaces of the mantle molding member.

The apparatus of the present invention also includes an internal corner member for draining away water collected on top of the mantle molding member so that the water does not enter behind any portion of the siding on the building. The internal corner member includes a channel which receives water draining from an outer surface of the mantle molding member and directs the water away from the doorway opening in the exterior surface of the building. The internal corner member is easily covered by a decorative, outer corner member, which can be secured thereover.

In an alternative embodiment a window header assembly is disclosed which is adapted to be secured to an exterior flat surface of a structure, such as brick, or prior to the installation of siding on the structure. Another alternative embodiment of the window header assembly is securable directly over siding on the exterior surface of the structure.

BRIEF DESCRIPTION OF THE DRAWINGS

The various advantages of the present invention will become apparent to one skilled in the art by reading the following specification and subjoined claims and by referencing the following drawings in which:

Alternative embodiments are also disclosed.

Figure 1:
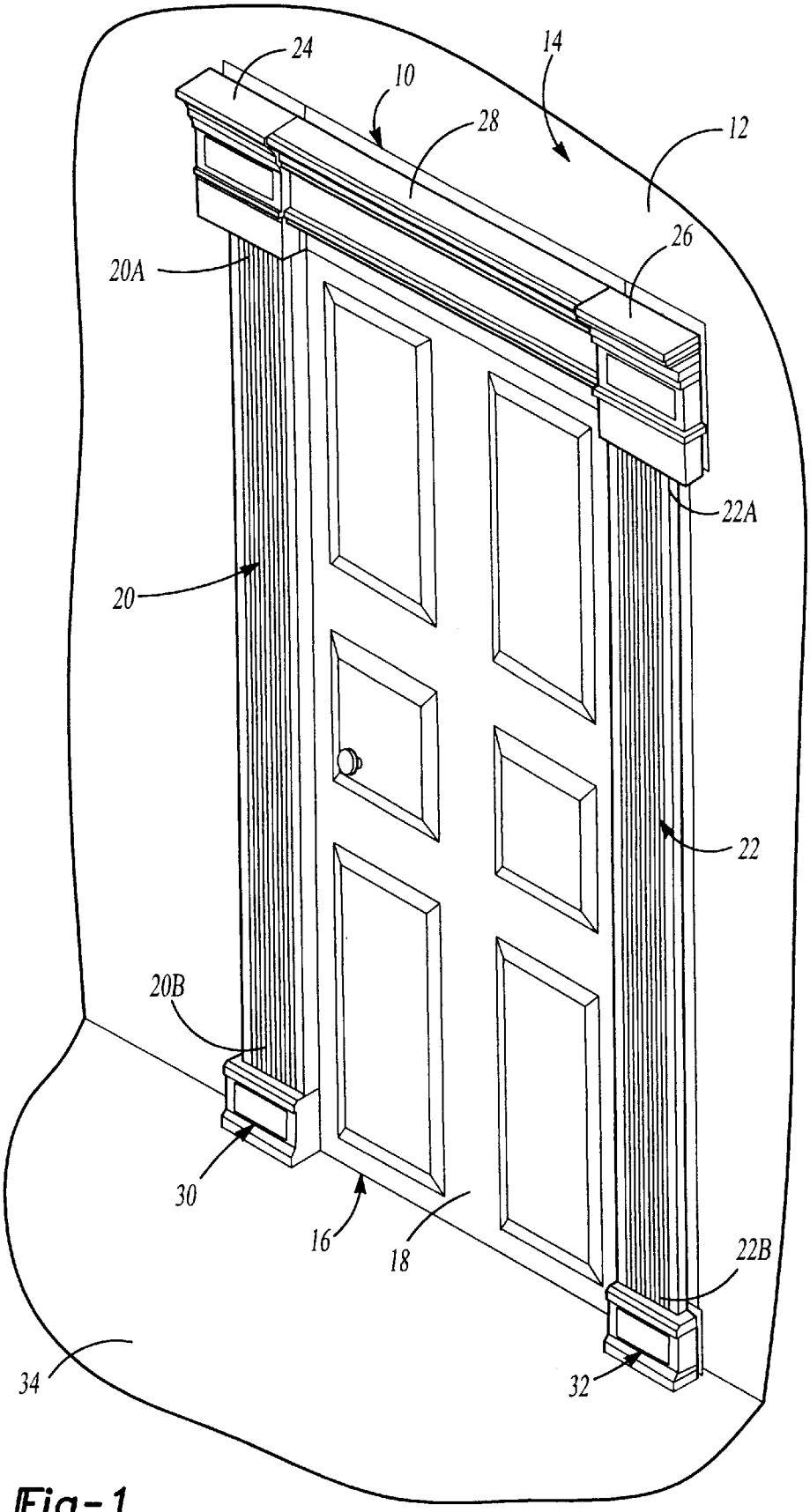
FIG. 1 is a perspective view of a door surround apparatus in accordance with a preferred embodiment of the present invention.
Figure 2:
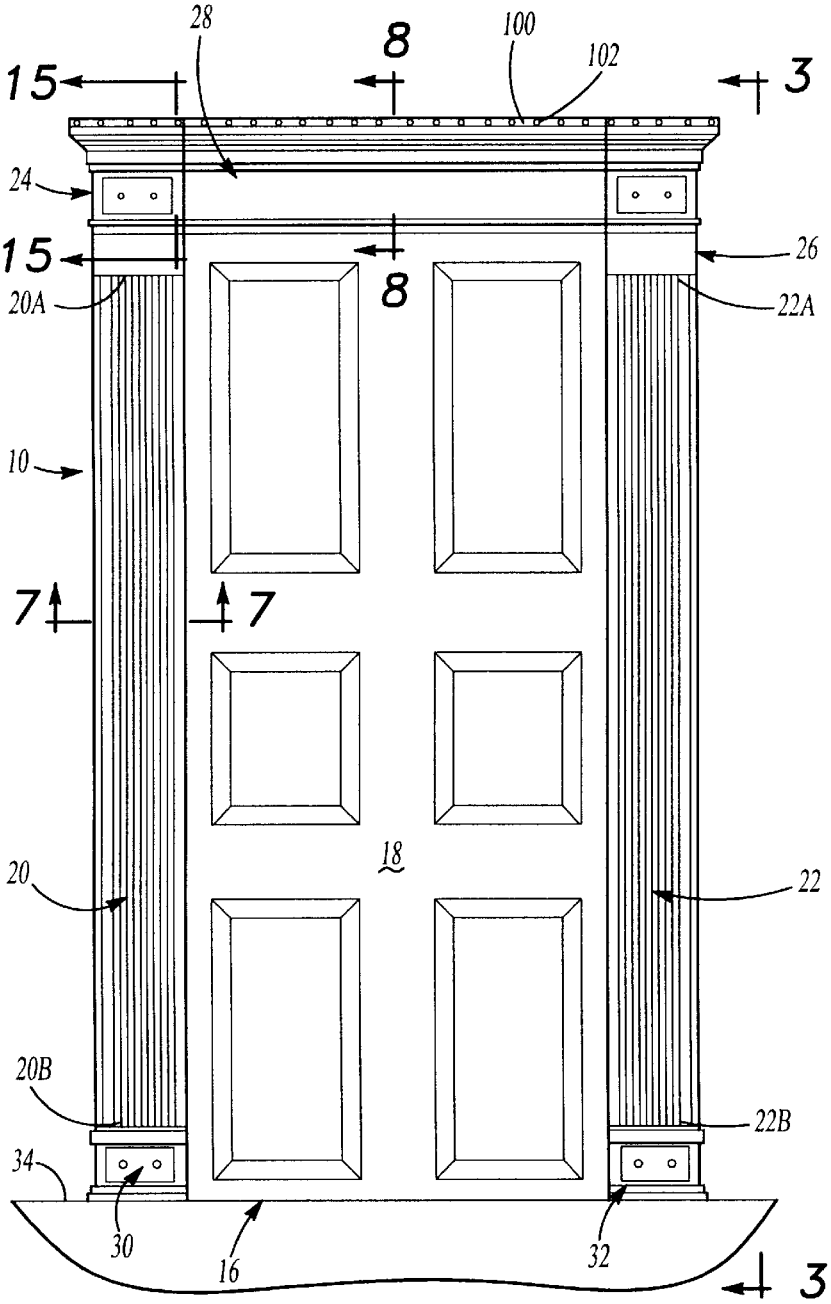
FIG. 2 is a front view of the apparatus in FIG. 1.
Figure 7:
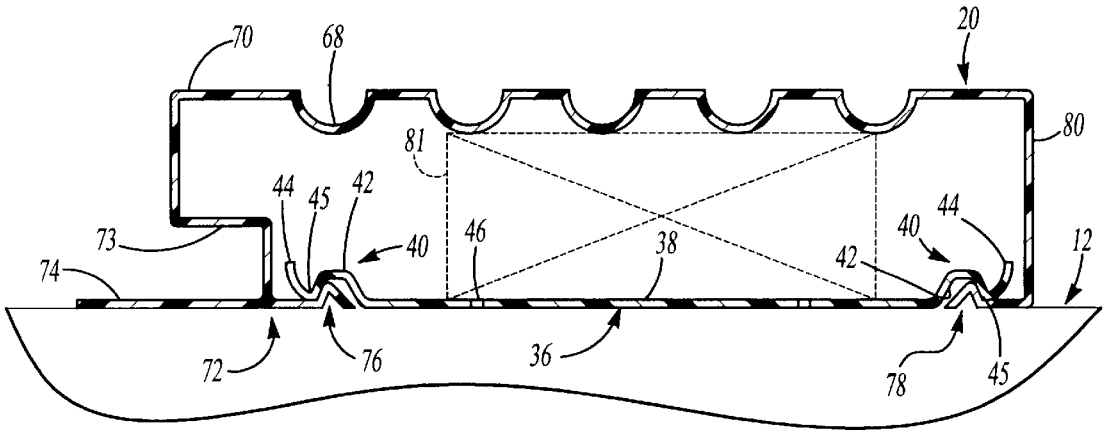
Figure 7A:
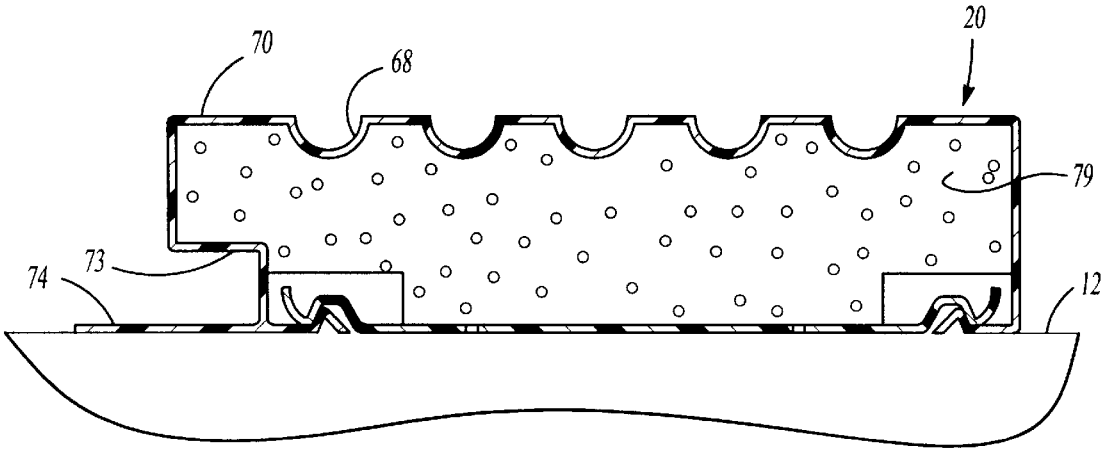
Figure 8:
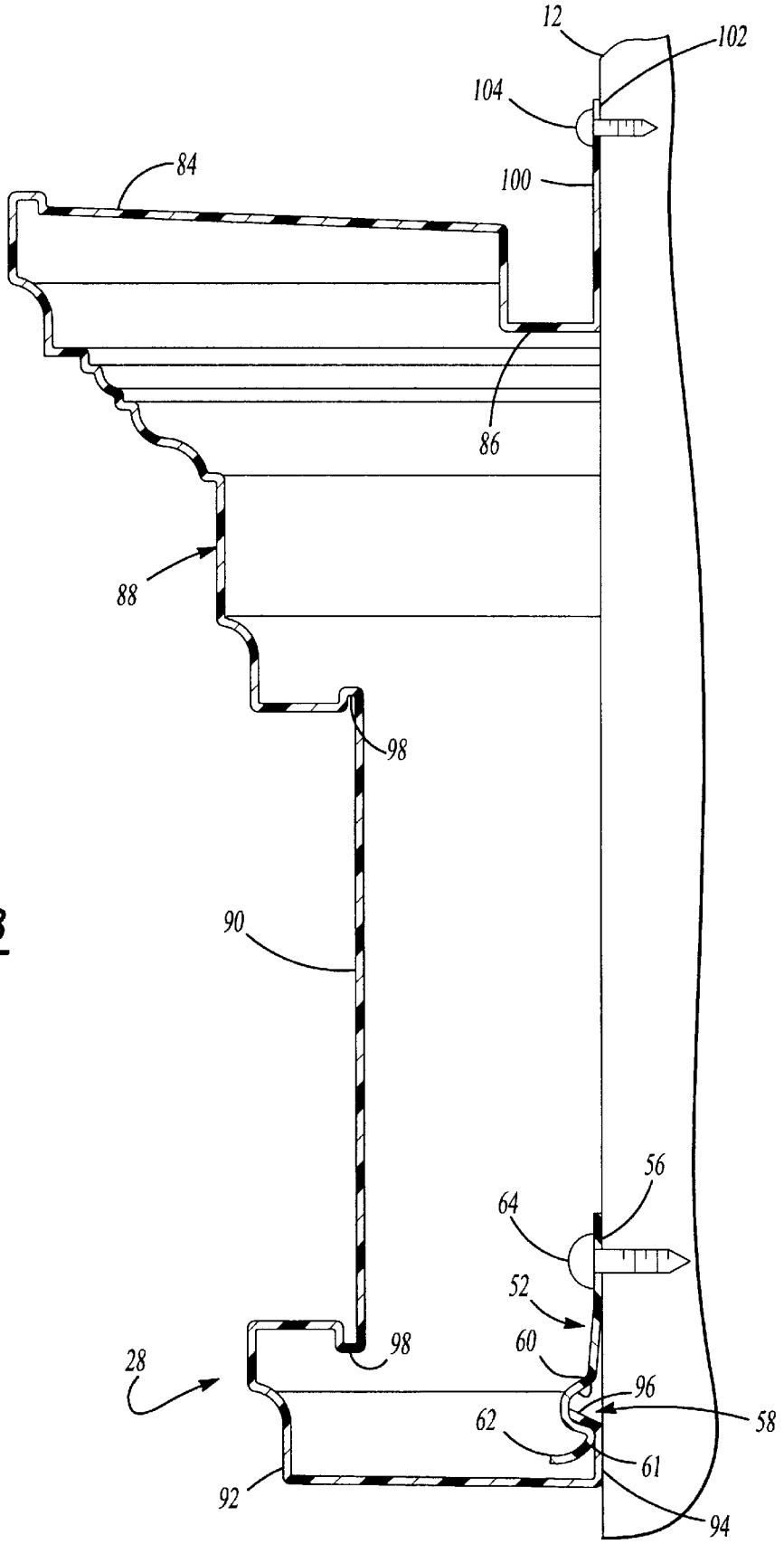
Figure 9:
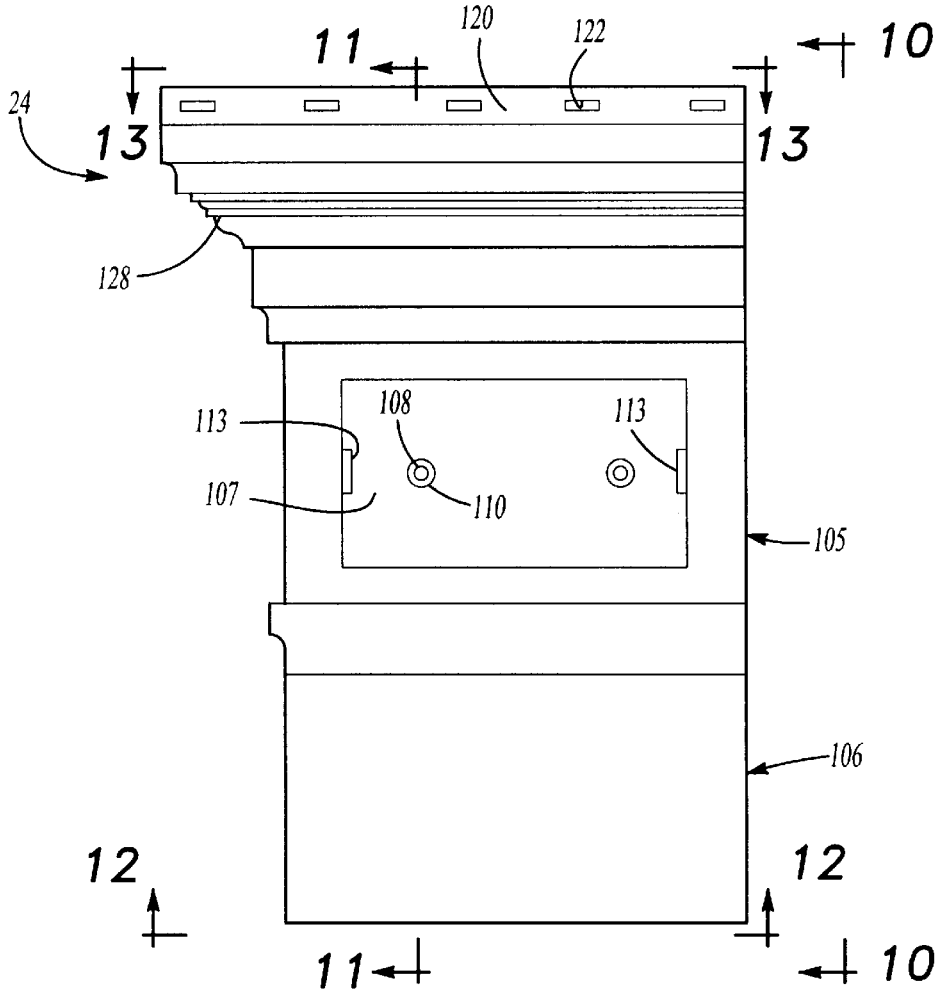
Figure 10:
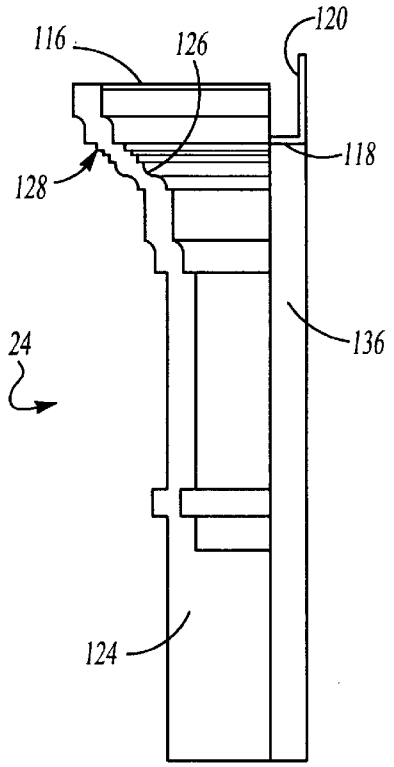
Figure 11:
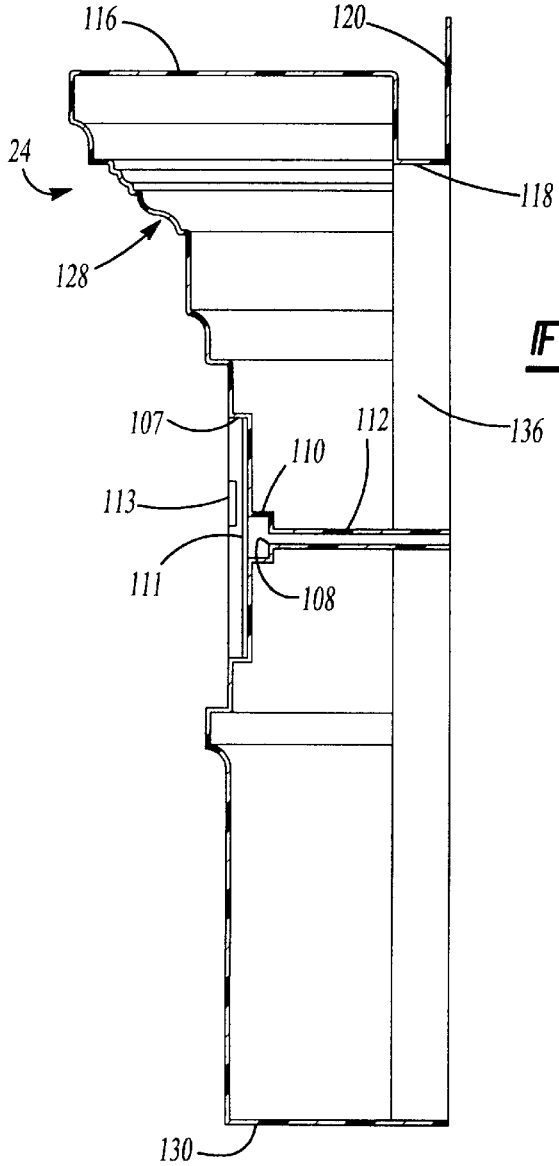
Figure 11A:
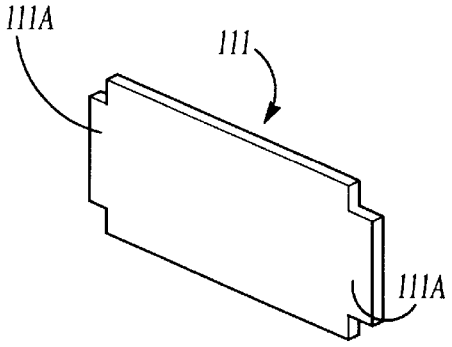
Figure 12:
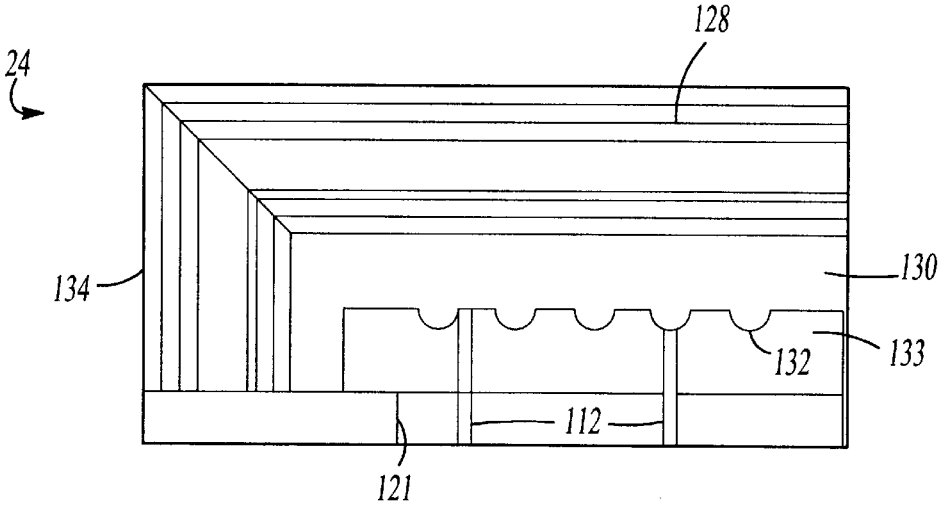
Figure 13:
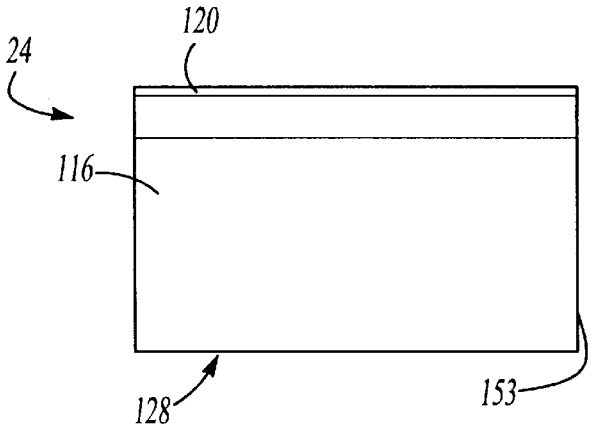
Figure 15:
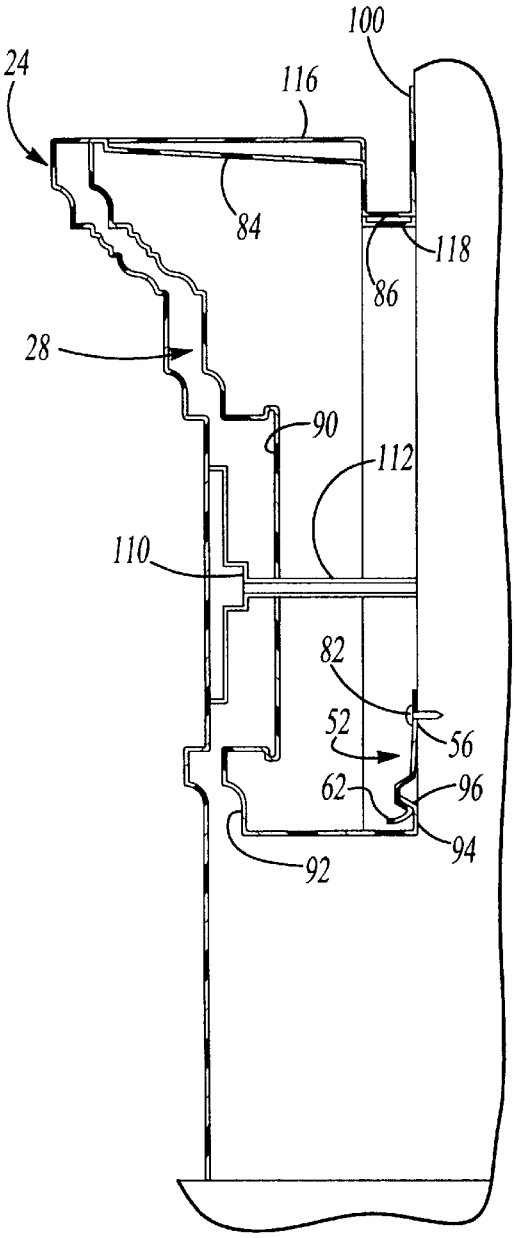
Figure 14:
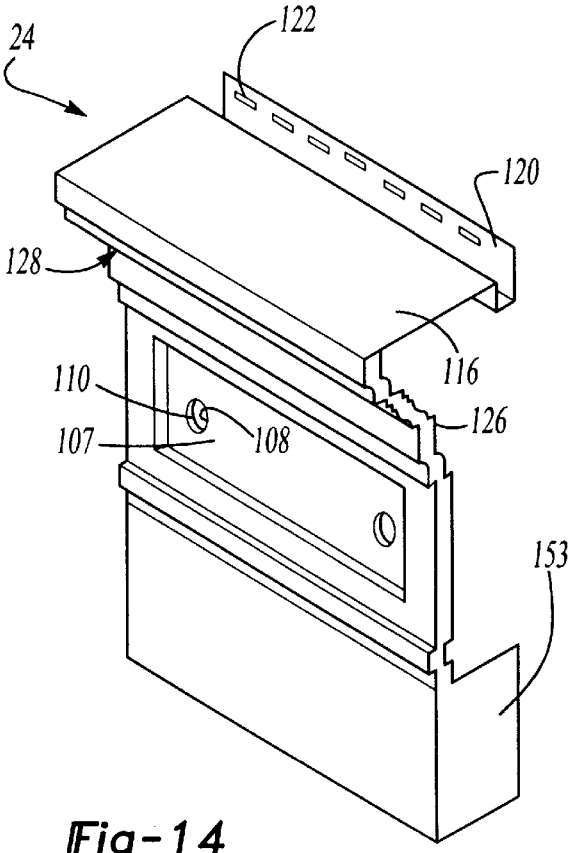
Figure 16:
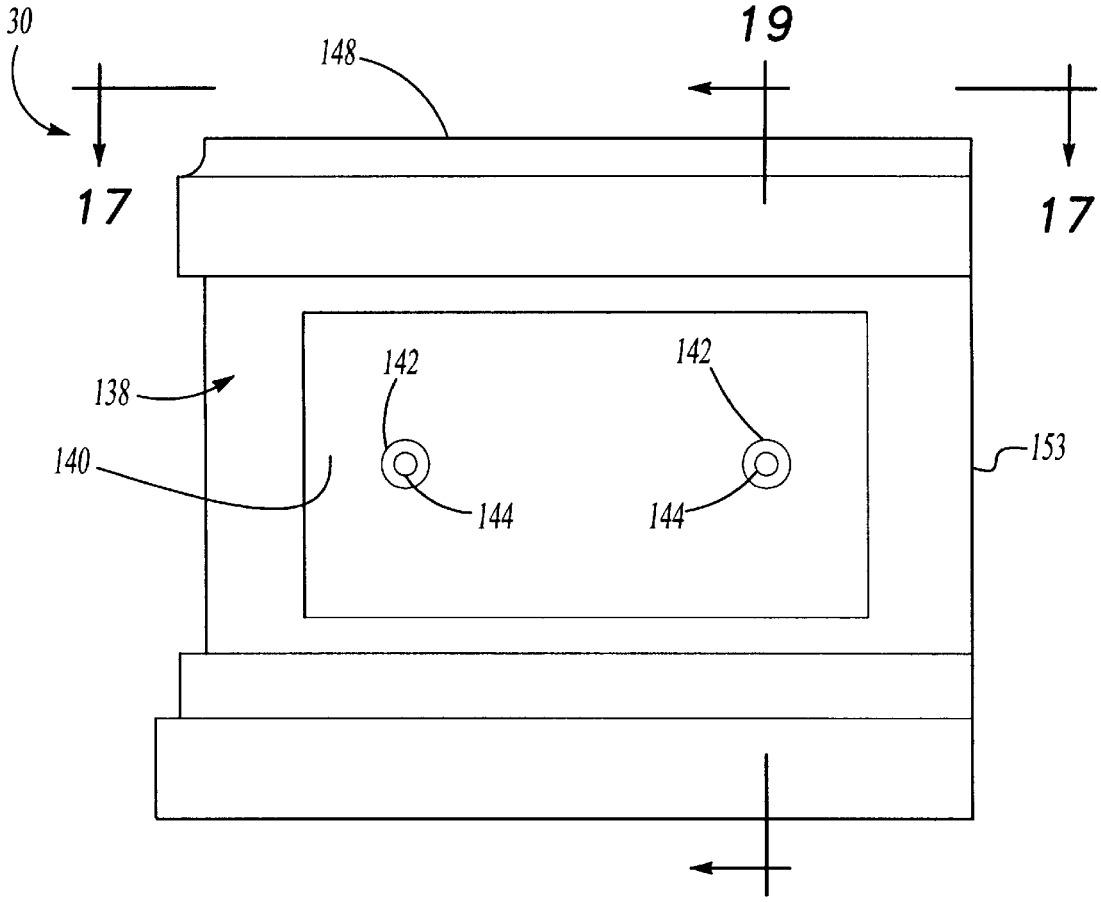
Figure 17:
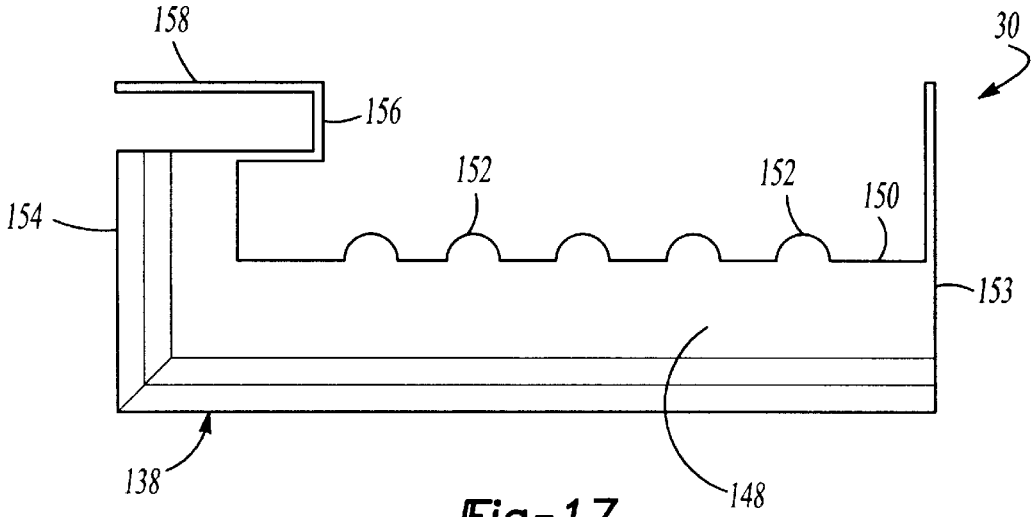
Figure 18:
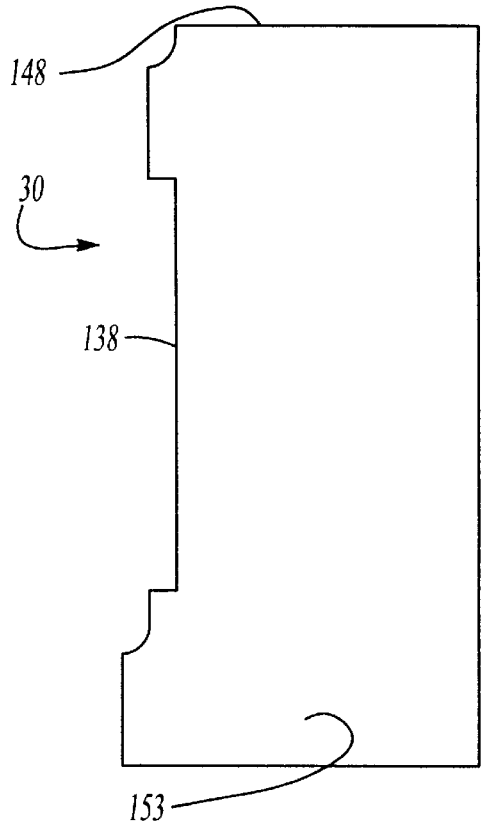
Figure 18A:
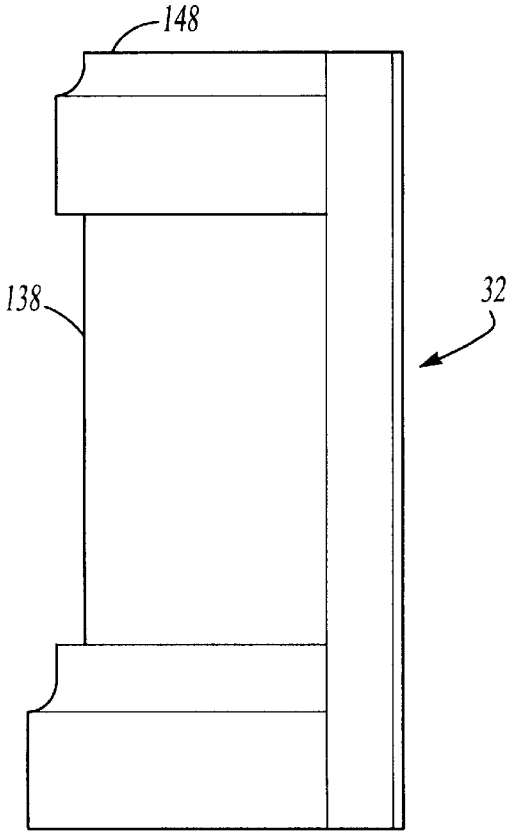
Figure 19:
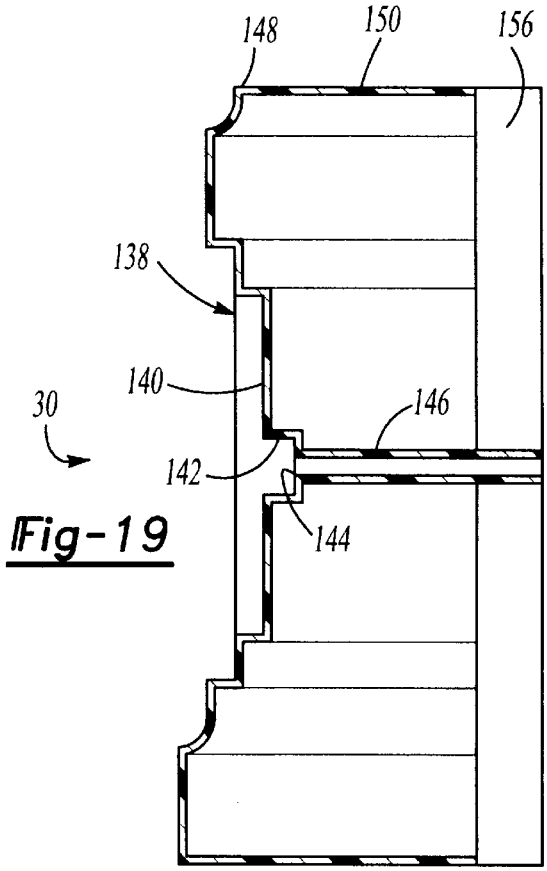
Figure 20:
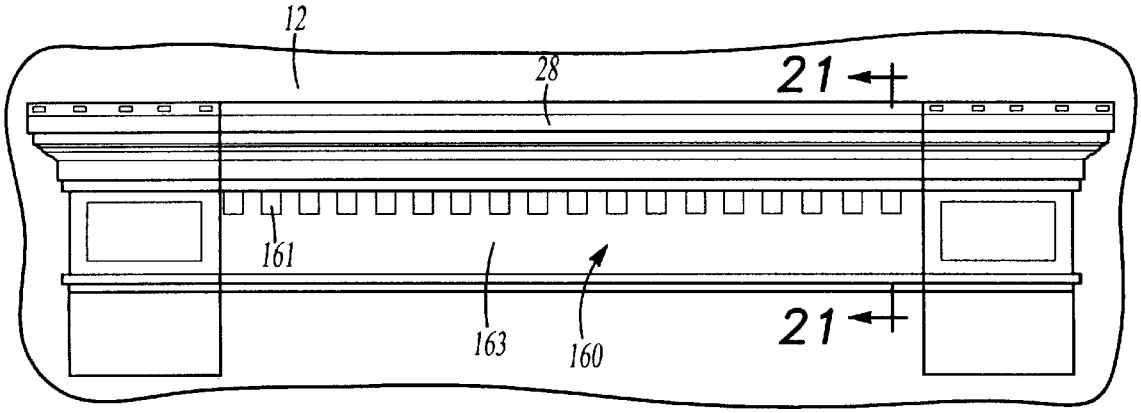
Figure 21:
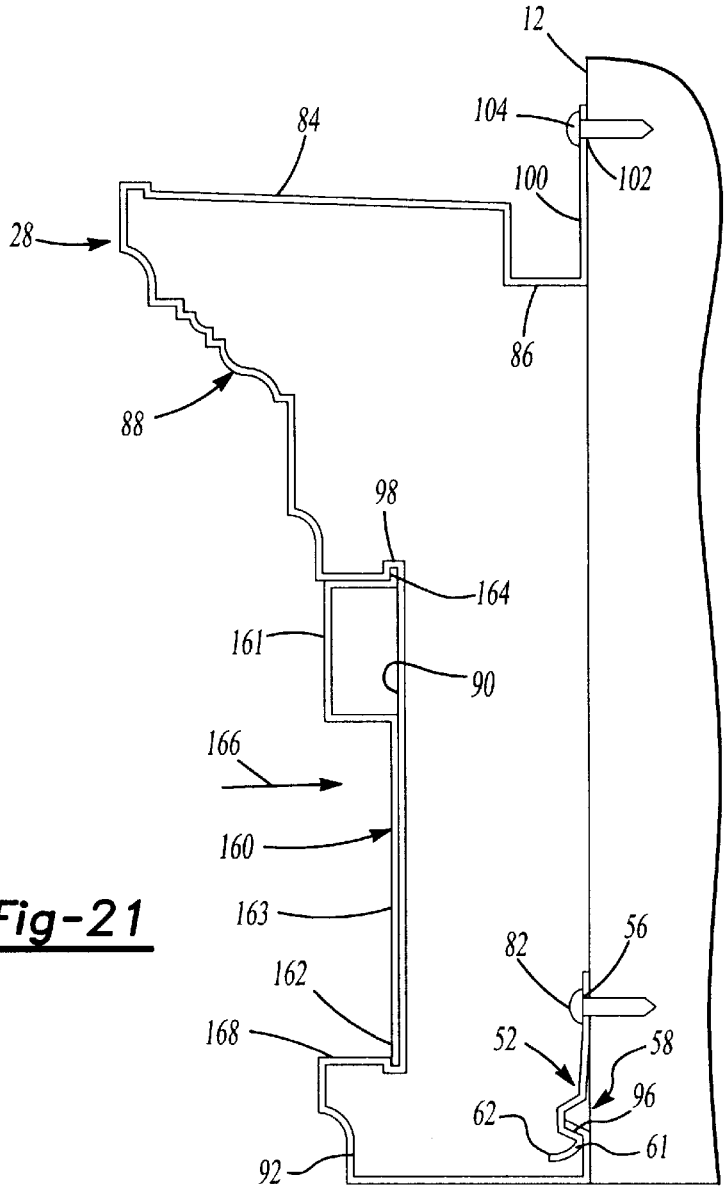
Figure 22:
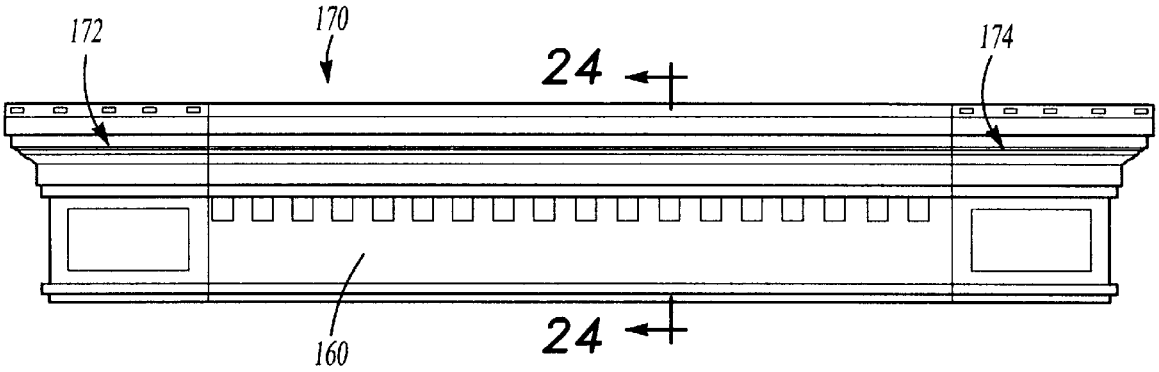
Figure 23:
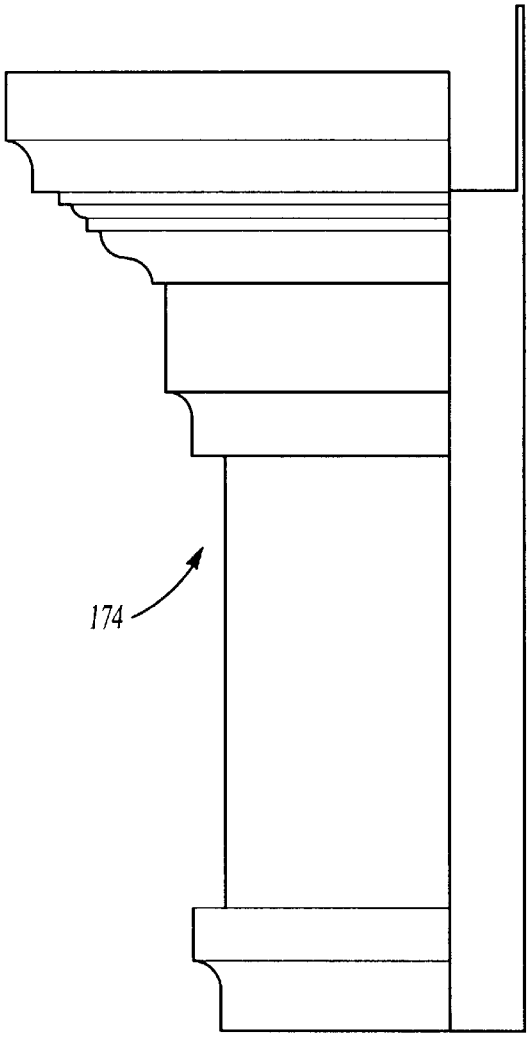
Figure 24:
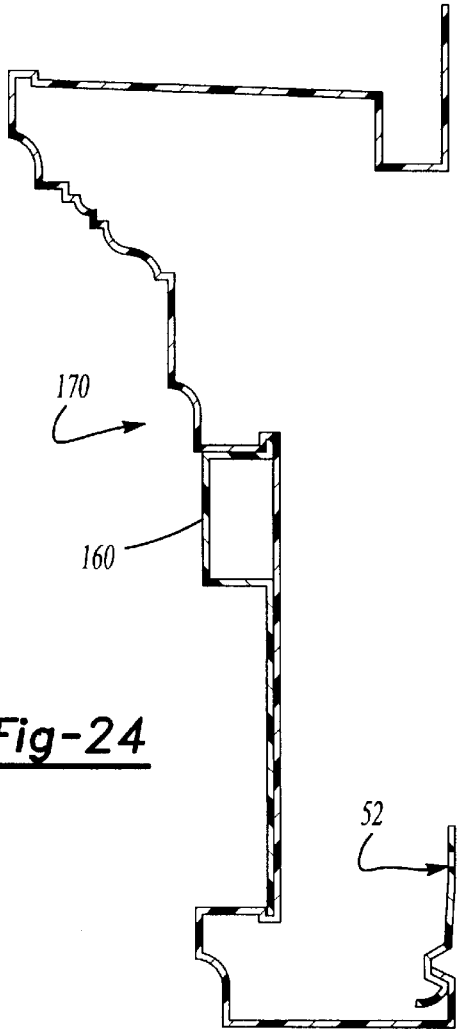

FIG. 7 is a cross-sectional view in accordance with section line 7—7 in FIG. 2 showing the left vertical molding member releasably secured to the vertical hanger member;

FIG. 7A is a view of an alternative preferred form of the vertical molding member shown in FIG. 7 which includes a foam block substantially filling an interior area of the vertical molding member to provide even further structural rigidity and support;

FIG. 8 is a side cross-sectional view in accordance with section line 8—8 in FIG. 2 showing the mantle molding member and a mantle hanger member secured to the wall of the structure;

FIG. 9 is a front view of the upper left corner member;

FIG. 10 is a right side view in accordance with directional line 10—10 in FIG. 9 of the upper left corner member shown in FIG. 9;

FIG. 11 is a side cross-sectional view of the upper left corner member shown in FIG. 9 in accordance with section line 11—11 in FIG. 9;

FIG. 11A is a perspective view of an optional cover member adapted to engage within the recess of a corner member;

FIG. 12 is a bottom view of the upper left corner member shown in FIG. 9 in accordance with directional line 12—12 in FIG. 9;

FIG. 13 is a top view of the upper left corner member shown in accordance with directional line 13—13 in FIG. 9;

FIG. 14 is a perspective view of the upper left corner member shown in FIG. 9;

FIG. 15 is a cross-sectional end view of the upper left corner member and mantle molding member taken substantially in accordance with section line 15—15 in FIG. 2 showing the orientation of these components when assembled together;

FIG. 16 is an enlarged front view of the left base molding member of the apparatus;

FIG. 17 is a top view of the base molding member shown in FIG. 16, taken in accordance with directional line 17—17 in FIG. 16;

FIG. 18 is a right side view of the left base molding member taken in accordance with directional line 18—18 in FIG. 16;

FIG. 18A is a right side view of the right base molding member shown in FIGS. 1 and 2;

FIG. 19 is a cross-sectional side view taken in accordance with section line 19—19 in FIG. 16 of the left base molding member;

FIG. 20 is a front view of a portion of the door surround assembly shown in FIG. 1 showing an optional dentil mantle component secured to the mantle molding member;

FIG. 21 is a right cross-sectional side view of the optional dentil mantle component secured to the mantle molding member, as taken in accordance with section line 21—21 in FIG. 20;

FIG. 22 is a front view of a window mantle molding assembly in accordance with an alternative preferred embodiment of the present invention;

FIG. 23 is a side view of the left upper corner member of the window mantle molding assembly shown in FIG. 22; and FIG. 24 is a side cross-sectional view of the window mantle member in accordance with section line 24—24 in FIG. 22.

Figure 25:
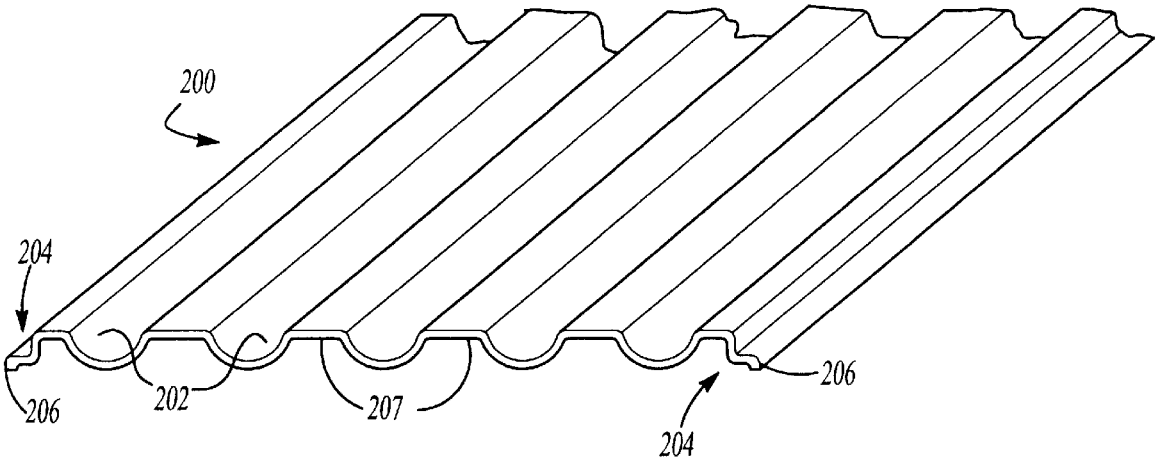
Figure 26:
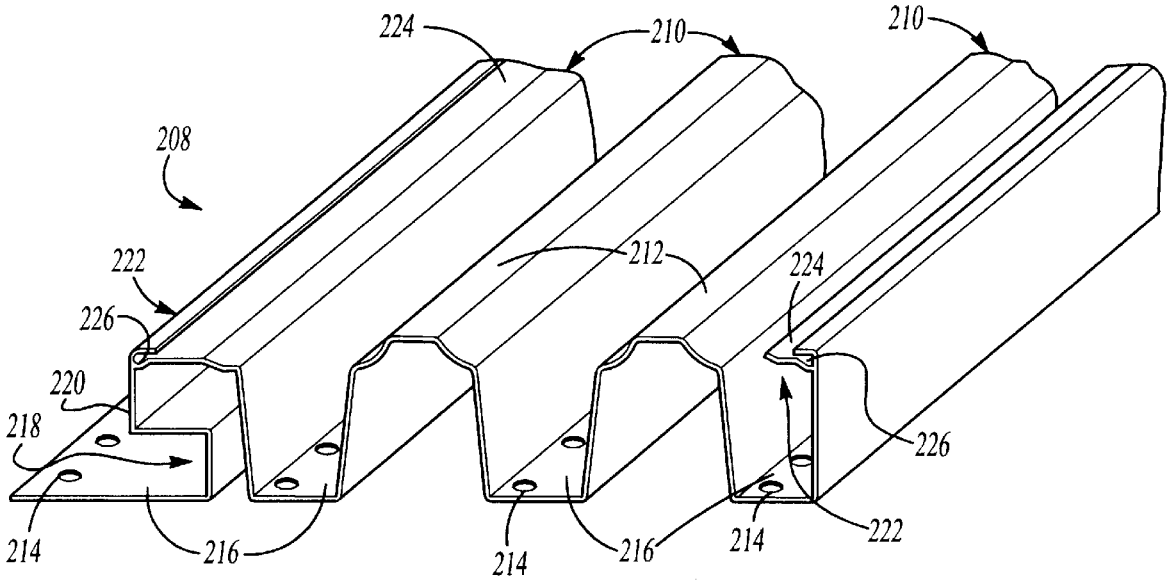
Figure 27:
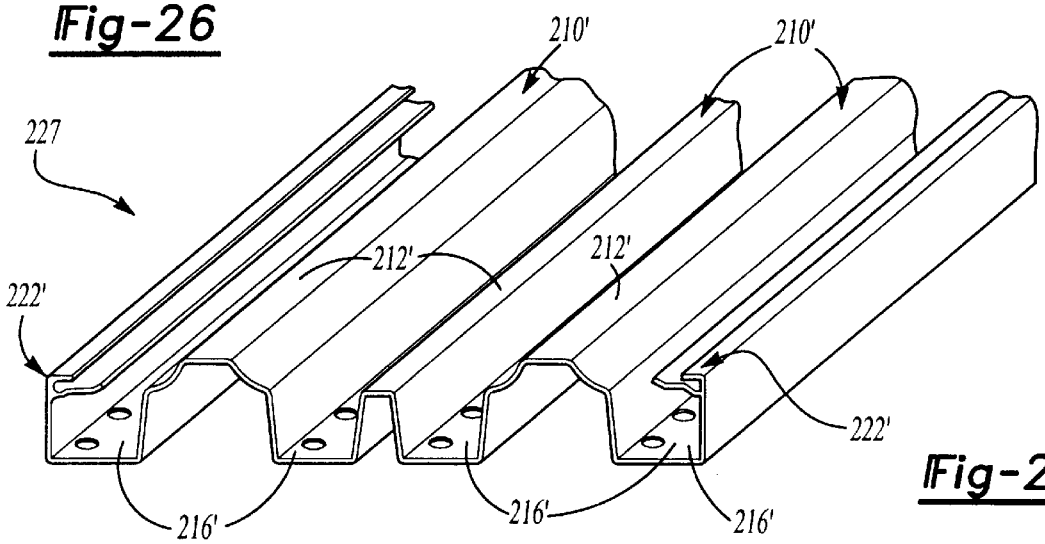
Figure 28:
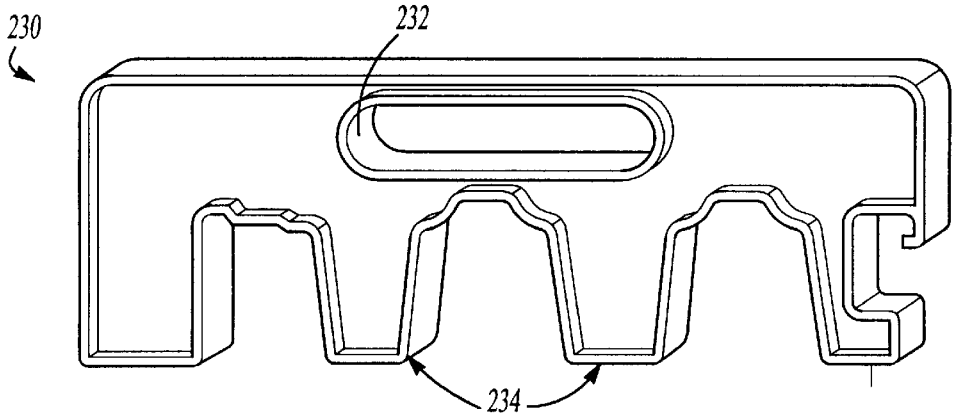
Figure 29:
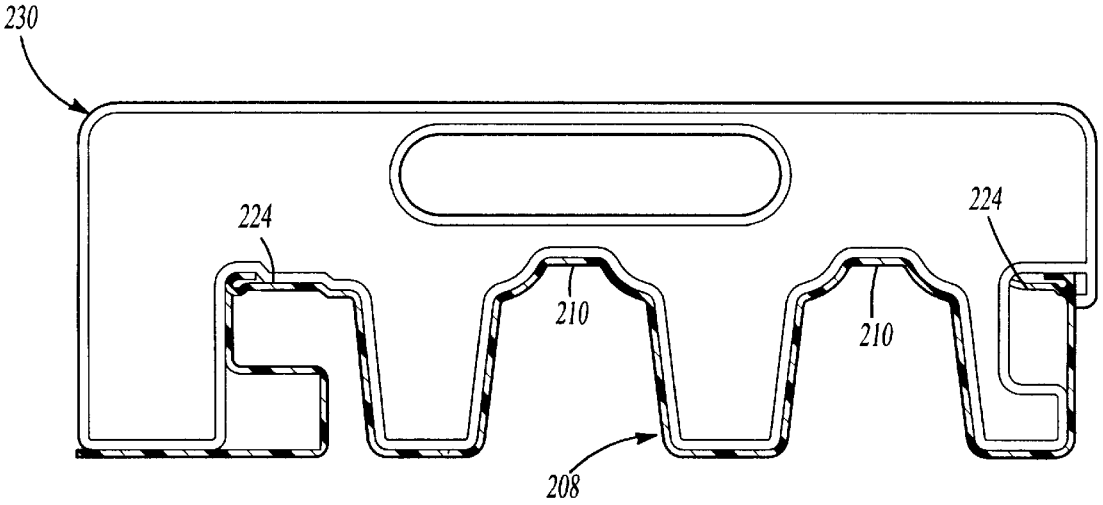
Figure 30:
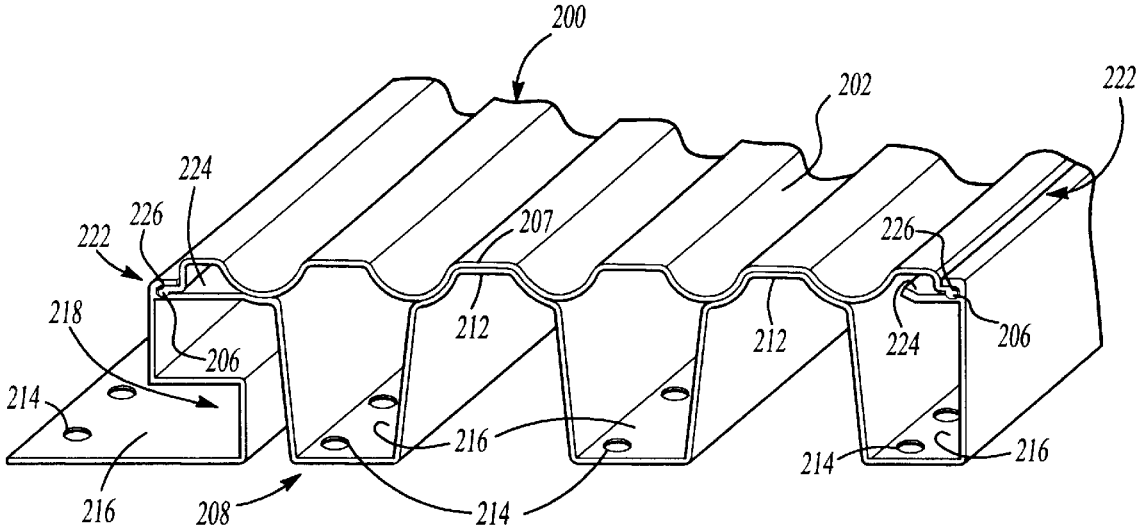
Figure 31:
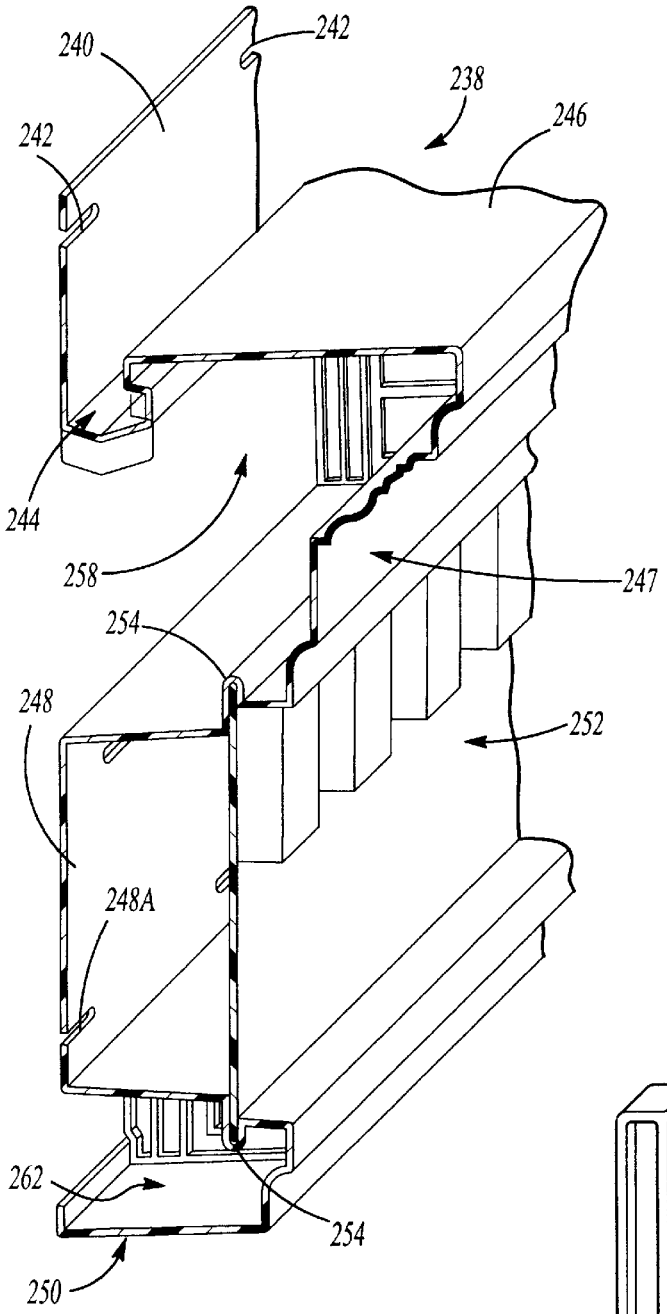
Figure 32:
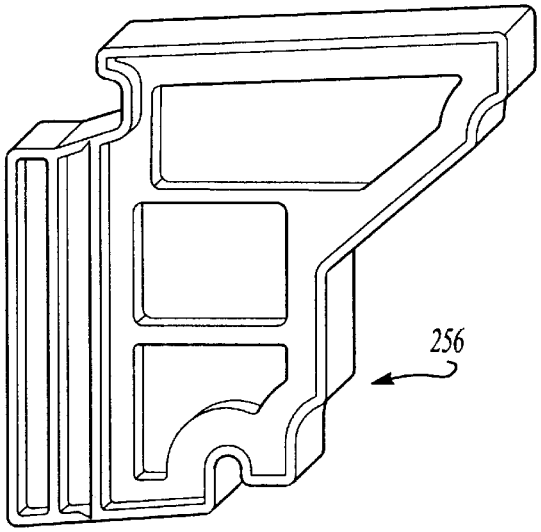
Figure 33:
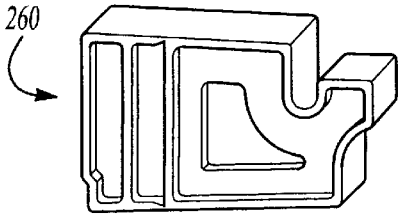
Figure 34:
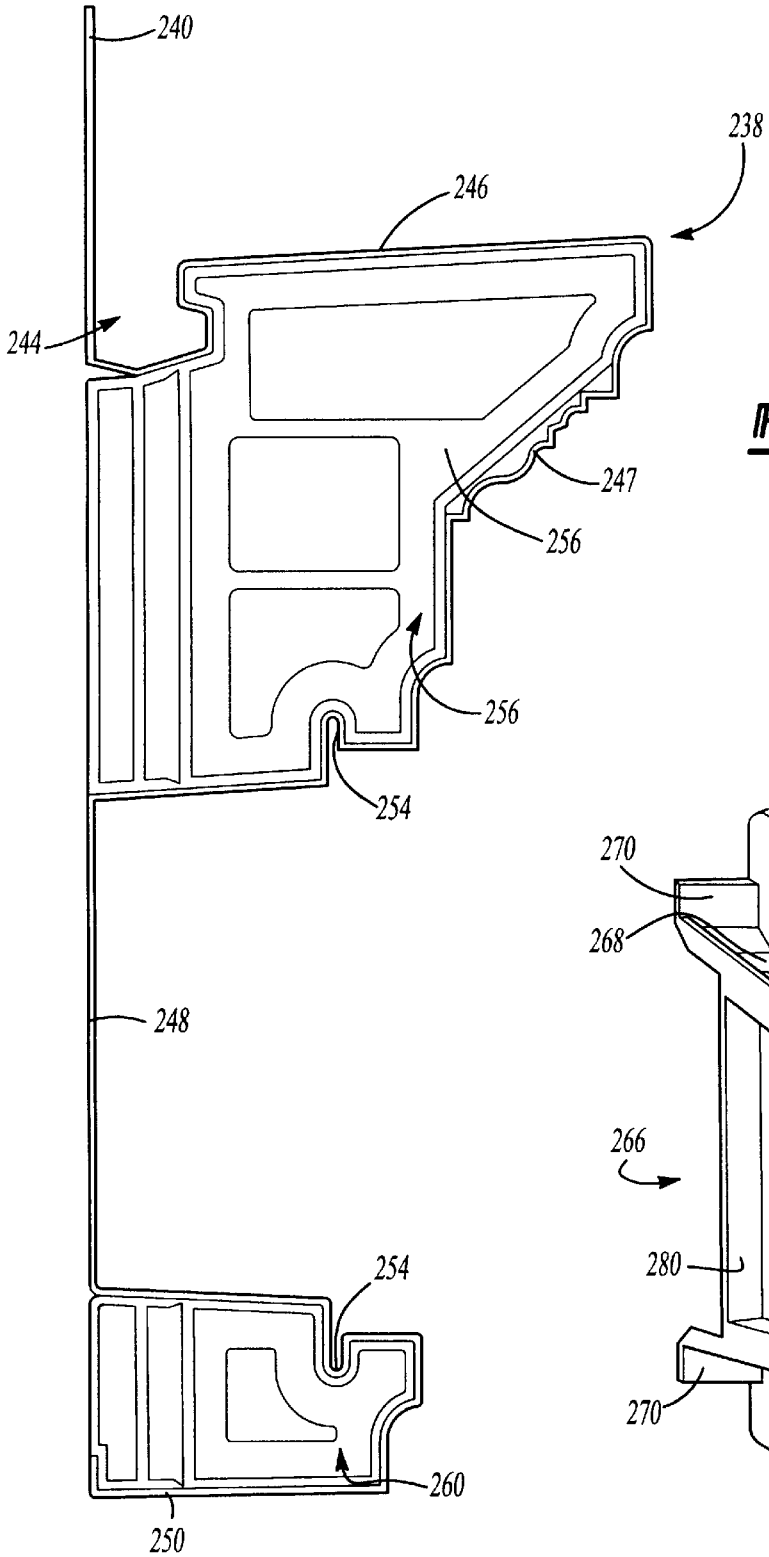
Figure 35:
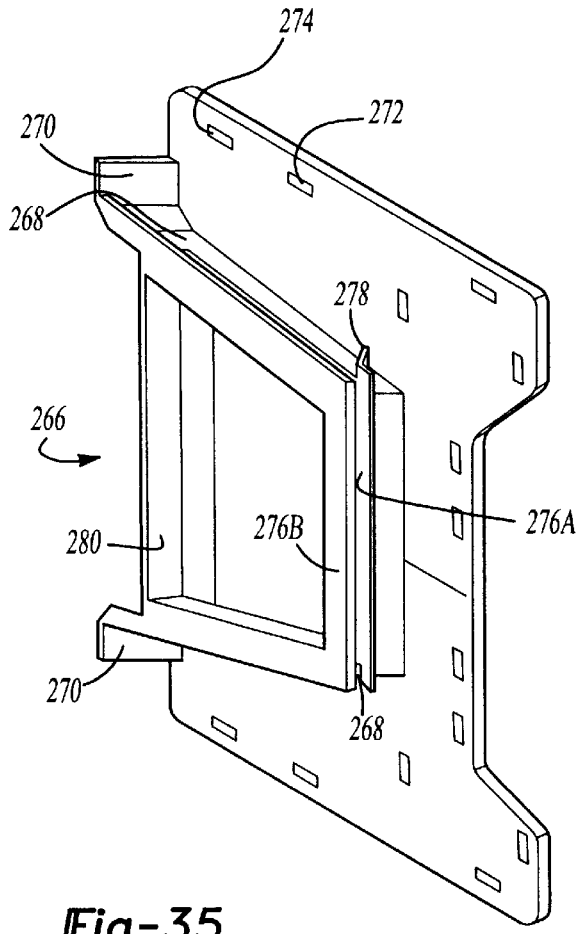
Figure 36:
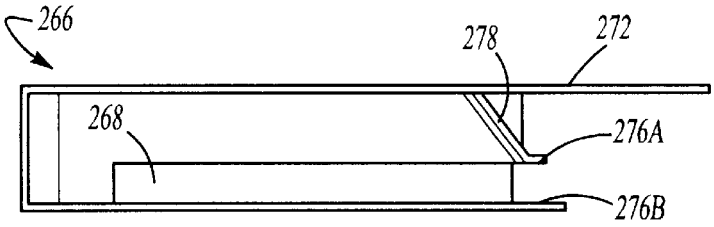
Figure 37:
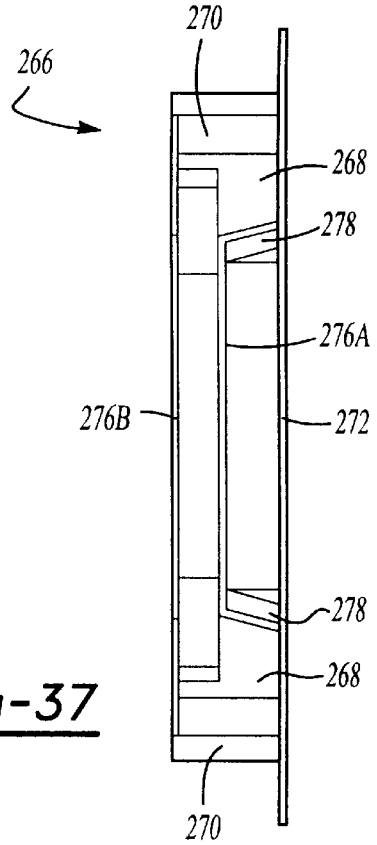

FIG. 25 is a perspective view of a portion of a molding member in accordance with an alternative preferred embodiment of the present invention;

FIG. 26 is a perspective view of a portion of a hanger member in accordance with an alternative preferred embodiment of the present invention;

FIG. 27 is a perspective view of a portion of another alternative preferred embodiment of a hanger member suitable to be secured to exterior surfaces covered with brick rather than siding;

FIG. 28 is a perspective view of an installation tool used to install the hanger member illustrated in FIG. 26;

FIG. 29 is a side view of the installation tool of FIG. 28 showing the tool positioned over a section of the hanger member during installation of the hanger member;

FIG. 30 is a perspective view of a portion of the hanger member of FIG. 26 showing a portion of the molding member of FIG. 25 secured thereto;

FIG. 31 is a perspective, cross-sectional view of a portion of a mantle member in accordance with an alternative preferred embodiment of the present invention, and further illustrating a portion of a dentil molding insert secured thereto;

FIG. 32 is a perspective view of an installation support used with the mantle member of FIG. 31;

FIG. 33 is a perspective view of a lower installation support also used with the mantle member of FIG. 31;

FIG. 34 is an end view of the mantle member shown in FIG. 31 illustrating the installation support members positioned within upper and lower cavities of the mantle member;

FIG. 35 is a perspective view of an internal corner member of the present invention;

FIG. 36 is a top view of the internal corner member of FIG. 35;

FIG. 37 is an end view of the internal corner member of FIG. 35; and

Figure 38:
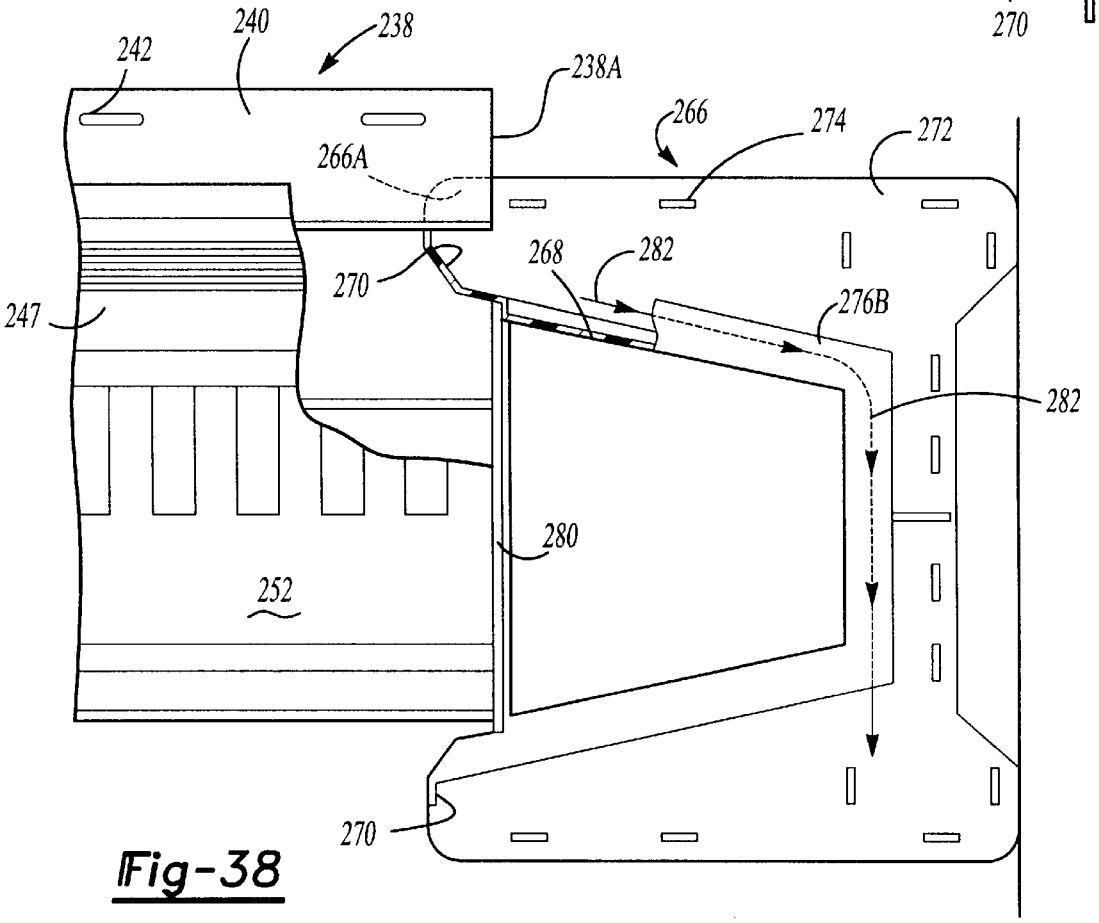
Figure 43:
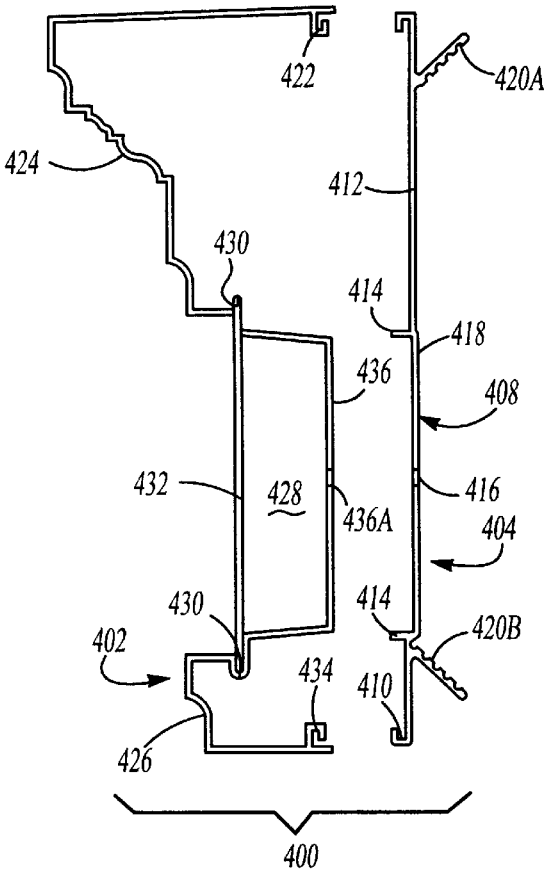
Figure 44:
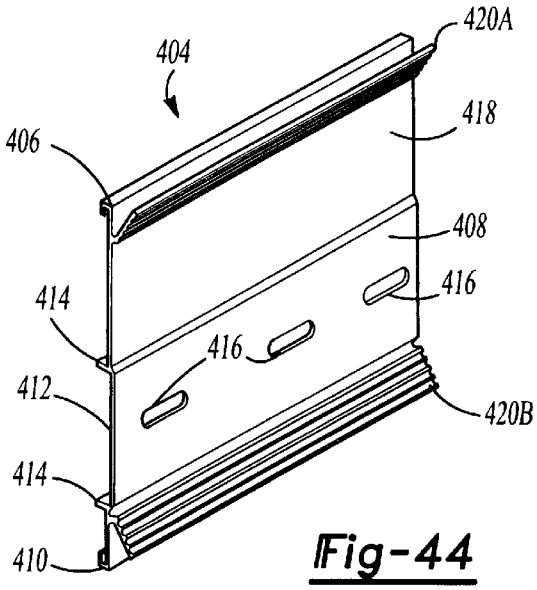
Figure 45:
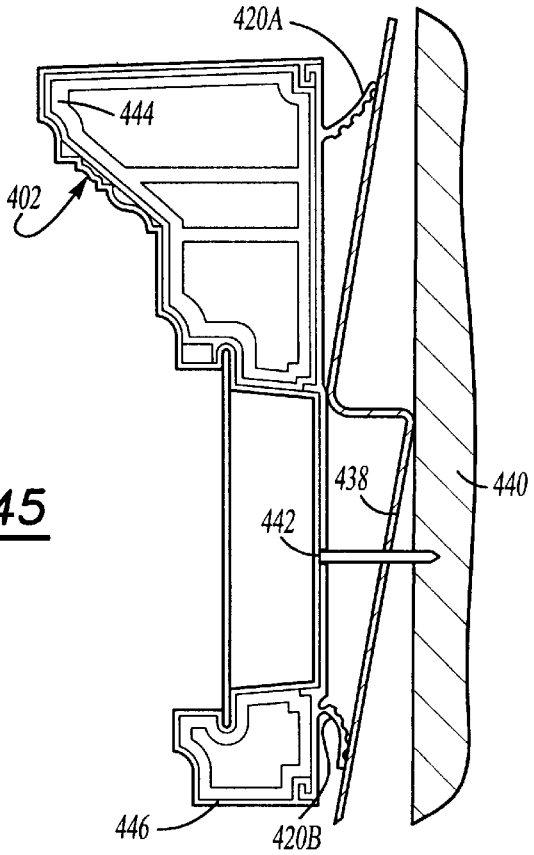

FIG. 38 is a view showing the internal corner member positioned adjacent one end of the mantle member and further illustrating how the internal corner member drains away water captured within a channel of the mantle member;

FIG. 39 is a perspective view of a window header apparatus in accordance with another alternative preferred embodiment of the present invention;

FIG. 40 is a cross sectional side view of the apparatus in accordance with section line 40—40 in FIG. 39;

FIG. 41 is a perspective view of an upper installation support used with the apparatus of FIG. 39;

FIG. 42 is a perspective view of a lower installation support used with the apparatus of FIG. 39;

FIG. 43 is a side view of another alternative preferred embodiment of the present invention adapted to be installed on a flat surface or structure after siding has been secured to the structure;

FIG. 44 is a perspective view of the hanger member shown in FIG. 43, and FIG. 45 is a side cross-sectional view of the apparatus of FIG. 43 secured to an exterior surface of a structure.

DETAILED DESCRIPTION OF THE PREFERRED EMBODIMENTS

Referring to FIG. 1, there is shown a door surround molding apparatus 10 in accordance with a preferred embodiment of the present invention. It will be appreciated immediately that while the apparatus 10 is illustrated in FIG. 1 as a decorative door surround molding apparatus, that the apparatus is equally well suited to be used in archways, to surround windows and on various other portions of residential and commercial structures, as will be discussed further in the following paragraphs.

With further reference to FIG. 1, the apparatus 10 is secured to a wall 12 of a structure 14 such as a commercial building or residential dwelling. The apparatus 10 forms a door surround for a doorway 16 to provide a decorative, aesthetically appealing framework for a door 18 of the structure 14.

Figure 3:
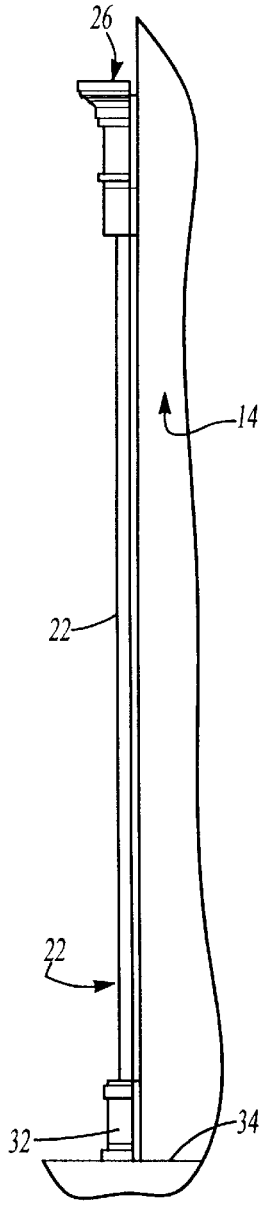
FIG. 3 is a side view of the apparatus shown in FIG. 2 in accordance with directional arrow 3—3 in FIG. 2.

With reference to FIGS. 1–3, the apparatus 10 generally includes a pair of vertical molding members 20 and 22 which are essentially identical in construction, and sometimes referred to in the art as "pilasters". An upper left corner member 24, an upper right corner member 26 and a mantle molding member 28 together form a mantle which has the appearance of being integrally formed as a single piece component. Each of the upper corner members 24 and 26 are positioned to partially cover upper terminal end portions 20*a* and 22*a* of the vertical molding members 20 and 22, respectively, so that the apparatus 10 surrounds the doorway 16 without any visible discontinuities or gaps.

With further reference to FIGS. 1 and 2, a left decorative base molding member 30 and a right decorative base molding member 32 are secured to the wall 12 to partially cover a lower terminal end portion 20*b* of the vertical molding member 20 and a lower terminal end portion 22*b* of the vertical molding member 22, respectively. The base molding members 30 and 32 are further positioned such that they rest on or very closely adjacent a floor portion 34, which typically is a concrete porch.

Figure 4:
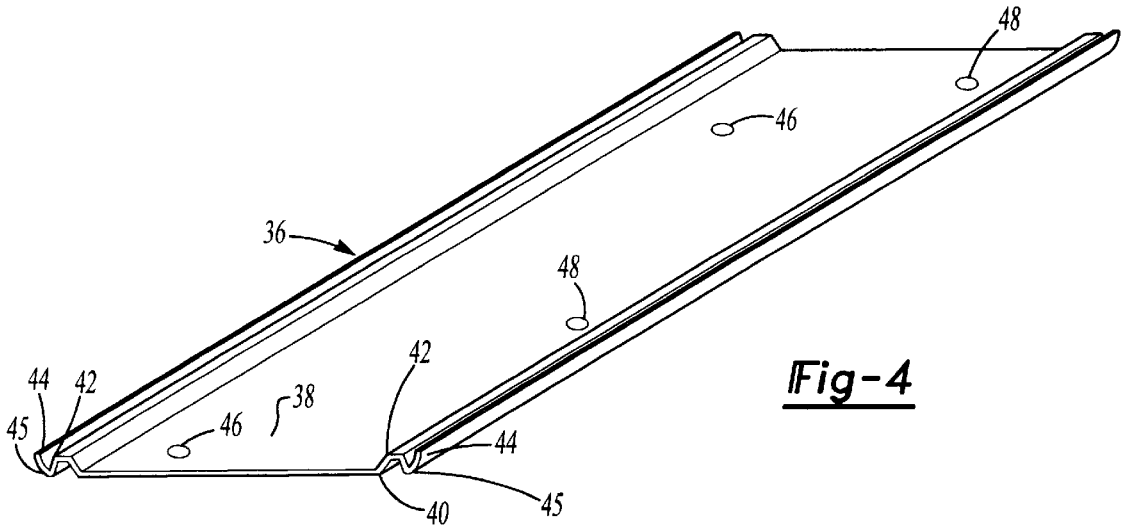
FIG. 4 is a perspective view of a representative portion of a vertical hanger member used to secure a vertical molding member of the apparatus against the wall of the structure shown in FIGS. 1 and 2.

Referring now to FIG. 4, the door surround molding apparatus 10 further includes a hanger member 36 which is used in connection with one of the vertical molding members 20 or 22 to secure the molding member to the wall 12 of the structure 14. Hanger member 36 includes a main body portion 38 and a pair of securing portions 40 formed longitudinally along opposite sides, widthwise, of the main body portion 38. Each securing portion 40 includes a channel 42, a corner portion 45 and a lip portion 44 depending from each corner portion 45. Each securing portion 40 further extends preferably along at least a major portion of the length of the hanger member 36, and more preferably along the entire length of the hanger member 36. The main body portion 38 further includes a first row of apertures 46 and a second row of apertures 48. The apertures 46 are further staggered or offset from the apertures 48 such that no two apertures 46 and 48 are perfectly horizontally or perpendicularly aligned with one another.

Figure 5:
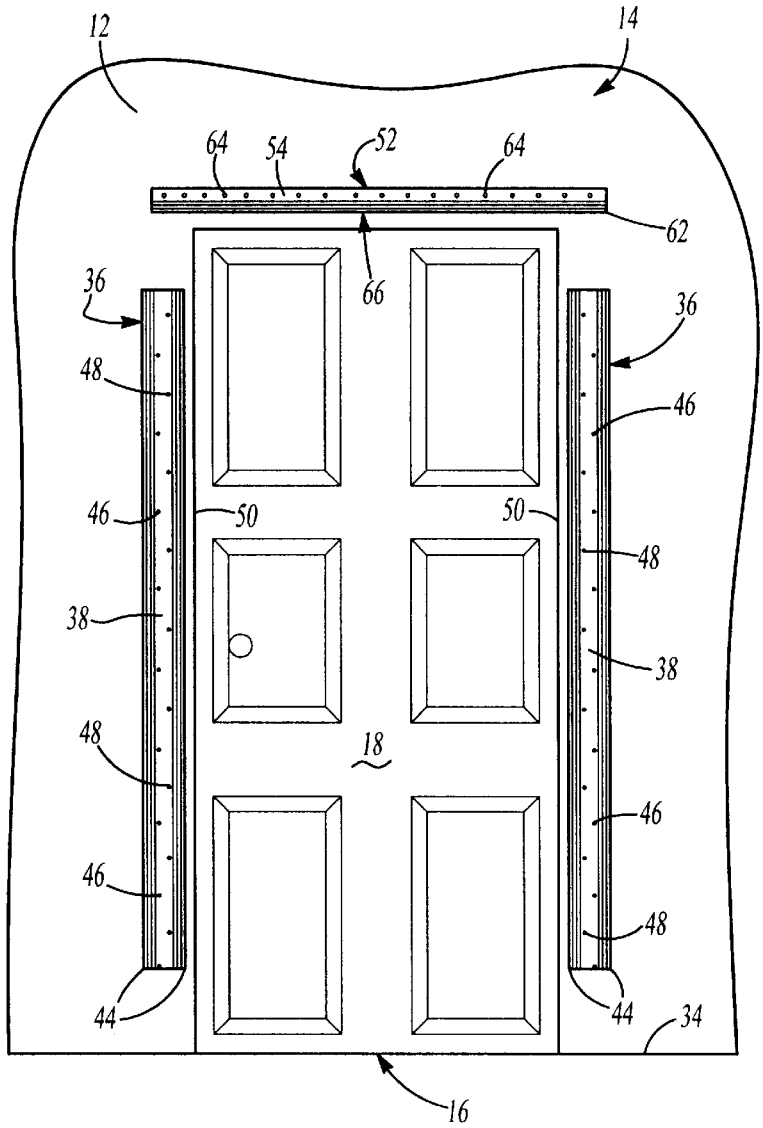
FIG. 5 is a front view of a doorway illustrating a pair of vertical hanger members secured along vertical portions of the doorway and a mantle hanger member secured to the wall of the structure along a top portion of the doorway.

With reference to FIG. 5, the hanger members 36 are shown secured along vertical wall portions 50 of the doorway 16 such that the hanger members 36 are positioned generally parallel to the vertical portions 50 of the doorway 16. Each of the vertical hanger members 36 are secured via conventional nails or threaded fasteners through the apertures 46 and 48 in each to the wall 12 of the structure 14 such that the lip portions 44 of each hanger member 36 project outwardly away from the wall 12, and the main body portion 38 rests flush against the wall 12. The staggered apertures 46 and 48 allow the hanger members 36 to be held securely against the wall 12 in a manner which ensures that the hanger members 36 follow the contour of the wall 12 even if the wall 12 includes slight undulations.

Figure 6:
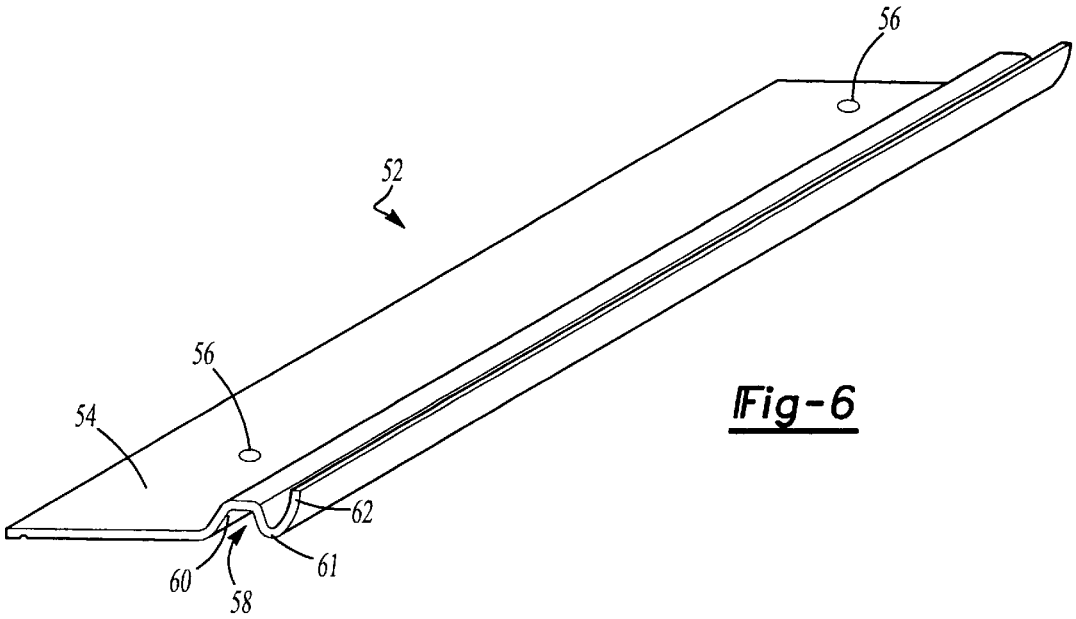
FIG. 6 is a perspective view of a representative portion of the mantle hanger member shown in FIG. 5.

Referring to FIG. 6, the door surround molding apparatus 10 further includes a mantle hanger member or strip 52 for supporting the mantle molding member 28 (FIGS. 1 and 2) securely against the wall 12 of the structure 14. The mantle hanger member 52 includes a main body portion 54 having a plurality of apertures 56 spaced there along and a securing portion 58 extending preferably along at least a major portion of its length, and more preferably along the entire length of the member 52. The securing portion 58 includes a channel 60, a corner portion 61 and a lip portion 62 depending from the corner portion 61.

With further brief reference to FIG. 5, during installation of the door surround apparatus 10, the mantle hanger member 52 is secured by a plurality of fastening members 64 in the form of nails or threaded screws along a horizontal top portion 66 of the doorway 16. The mantle hanger member 52 is secured closely parallel to the top portion 66.

Referring now to FIG. 7, the interengagement of the vertical hanger member 36 and the vertical molding member 20 can be seen. Also clearly apparent are a plurality of spaced apart grooves 68 formed in a front surface 70 of the molding member 20. It will be appreciated that the vertical molding member 22 is identical to the vertical molding member 20 in construction, but is rotated 180° from the position it is placed in on the left side of the doorway 16 shown in FIG. 2. The vertical molding member 22 includes an identical plurality of grooves so that the two molding members 20 and 22 provide a uniform and symmetrical appearance along the opposite vertical sides 50 of the doorway 16.

With further reference to FIG. 7, the vertical molding member 20 includes an inverted T-shaped base portion 72 including a planar flange 74 and a first securing portion 76 in the form of an inverted V-shaped shoulder. The flange 74 helps to form a channel 73 extending along the length of the molding member 20. A second securing portion 78, also taking the form of an inverted V-shaped shoulder portion, is formed at a terminal end of a sidewall portion 80 of the molding member 20. The vertical molding member 20 may be formed from a variety of manufacturing techniques and materials, but is preferably extruded from polypropylene. Alternatively, the molding member 20 could be extruded from polystyrene which would enable the molding member 20 to be readily painted or stained prior, or even subsequent to, installation.

With further reference to FIGS. 5 and 7, when the vertical molding member 20 is to be secured to its associated hanger member 36, the second securing portion 78 is first urged into engagement with the securing portion 40 of the vertical hanger member 36 positioned closest to the doorway 16, along the entire length of the securing portion 40. Once fully engaged, the securing portion 78 rests within the channel 42 of its associated securing portion 40 and is held against the wall 12 by the corner portion 45 of the lip portion 44. The curvature of the lip portion 44 helps to urge the corner portion 45 gradually away from the wall 12 as the securing portion 78 is urged in the channel 42. Since the vertical hanger member 36 is relatively thin in cross-section, preferably having a thickness within the range of about 0.050 to about 0.080 inches, it is able to flex slightly along its main body portion 38 to help allow the securing portions 40 to be urged away from the wall 12 temporarily when the vertical molding member 20 is being secured thereto. The slight flexibility of the hanger member 36 also enables each securing portion 40 thereof to exert a biasing force towards the wall 12 to help releasably secure the molding member 20 to the wall 12. The hanger member 36 is preferably extruded from polypropylene.

With further reference to FIG. 7, once the second securing portion 78 is releasably engaged within its associated securing portion 40 of the hanger member 36, the first securing portion 76 may be urged into engagement with the other securing portion 40 of the hanger member 36 by pressing inwardly along the length of the channel 73 until the securing portion 76 engages within the channel 42 along the entire length of the channel 42. When fully engaged, the first securing portion 76 rests within the channel 42 and is held against the wall 12 by the corner portion 45 of its associated securing portion 40. From the above, then, it will be appreciated that the entire vertical molding member 20 is held against the wall 12 firmly, yet releasably, by the interengagement of the securing portions 76 and 78 with the securing portions 40 of the hanger member 36. Accordingly, there is no need for any external fasteners such as nails or threaded screws to be secured through any portion of the molding member 20 itself, which might be visible and require further components or assembly steps to cover from view. The releasable interengagement of the vertical molding member 20 with the hanger member 36 further enables the molding member 20 to be more quickly and easily removed from the wall 12 if disassembly of the molding member 20 is required for any reason after initial assembly of the door surround apparatus 10.

With reference to FIG. 7A, it will also be appreciated that the interior area of the vertical molding member 20 could be partially filled with a foam block 79 or one or more interior ribs (not shown) which provide even further structural rigidity to the molding member 20 when the molding member 20 is secured to the wall portion 12. Alternatively, as shown in FIG. 7 in phantom, a conventional 2"×4" stud 81 could simply be placed in the interior area of the vertical molding member 20 or alternatively secured to the wall 12 directly over the main body portion of the vertical hanger member 36.

Referring now to FIG. 8, the mantle molding member 28 is shown secured to the mantle hanger member 52, which is in turn secured to the wall 12 via the plurality of fastening elements 64 such as nails or threaded screws which extend through the apertures 56. The mantle molding member 28 includes a top portion 84 having a U-shaped portion 86, a front face portion 88 having a planar support surface 90 and a bottom portion 92 having a securing portion 94 in the form of an angled lip 96. The front face portion 88 further includes a pair of spaced apart channels 98 formed adjacent the planar support surface 90. The U-shaped portion 86 further includes a mounting flange 100, also shown well in FIG. 2, which includes a plurality of elongated slots 102 formed there along which enable the mounting flange 100 to be secured to the wall 12 via a plurality of fastening elements 104 such as nails or threaded screws (with only one fastening element 104 being shown in FIG. 8).

With specific reference to FIG. 8, an important feature of the mantle molding member 28 is that the top portion 84 is formed such that it slopes downwardly towards the wall 12. This helps significantly in aiding water run-off from the molding member 28 which otherwise might run-off toward the front face portion 88 of the molding member 28 if the top portion 84 was not sloped downwardly towards the wall 12. The mantle molding member 28 is preferably extruded from polypropylene, polystyrene or any other suitably rigid yet lightweight plastic. Since the top portion 84 naturally assumes a slightly sloped orientation (because of being molded as such), there is no need for the individual installing the mantle molding member 28 to remember to urge the top portion 84 into a slightly downwardly sloped orientation relative to the wall 12 before securing the mounting flange 100 to the wall 12.

With continued reference to FIG. 8, when the mantle molding member 28 is secured to the mantle hanger member 52, the angled lip 96 of the securing portion 94 is first urged underneath the corner portion 61 of the securing portion 58 of the hanger member 52. Since the mantle hanger member 52 is relatively thin in cross-section, preferably about 0.050 to about 0.080 inches, it is slightly flexible and operates to exert a slight biasing force against the wall 12 to help hold the securing portion 94 firmly against the wall 12. Once the entire length of the angled lip 96 has been secured within the channel 60 of the mantle hanger member 52, the mounting flange 100 is then secured via fastening elements 104 to the wall 12. The elongated slots 102 allow for a small degree of longitudinal adjustment of the mantle molding member 28 prior to the fastening elements 104 being driven through the slots 102 into the wall 12. The slots 102 further allow for thermo-expansion of the mantle hanger member 52 after it is secured to the wall 12.

Referring now to FIGS. 9–14, the construction of the upper left corner member 24 is illustrated. With specific reference to FIGS. 9 and 10, the corner member 24 includes an upper portion 105 and a lower portion 106. The upper portion 105 includes a recessed area 107 having a pair of apertures 108. With brief reference to FIG. 11, each of the apertures 108 is formed within a generally circular recess 110 having a boss portion 112 extending therefrom.

With continued reference to FIGS. 9–11, the corner member 24 includes a top portion 116 which has a U-shaped portion 118 depending therefrom. The U-shaped portion 118 includes a flange 120 having a plurality of spaced apart, elongated slots 122. With specific reference to FIGS. 10 and 14, the corner member 24 further includes an inner side wall 124 having a cutout portion 126 which has a profile identical to an outer surface 128 of the upper portion 105 of the corner member 24, and further identical to the profile of the front face portion 88 of the mantle molding member 28 (shown in FIG. 8). The cutout 126 is further of a size to allow a portion of an end of the mantle molding member 28 to be inserted therein. With brief reference to FIG. 15, the mantle molding member 28 is shown positioned within the cut-out 126 illustrating how the front face portion 88 of the mantle molding member 28 forms a contour which is identical to the contour of the cut-out 126. It will be appreciated that the specific decorative contour of the corner members 24 and 26 and the mantle molding member can vary widely, and that the contours shown are merely for illustrative purposes.

Referring now to FIG. 12, the left upper corner member 24 includes a lower wall portion 130 having a plurality of spaced apart, semi-circular portions 132. The spaced apart portions 132 engage within the grooves 68 (FIG. 7) of the front surface 70 of the left vertical molding member 20 such that the upper terminal end portion 20*a* of the molding member 20 can be partially received within the interior area 133 of the corner member 24. An outer side wall 134 includes an interior wall portion 136 which fits within the channel 73 (FIG. 7) of the molding member 20 and over a portion of the flange 74 to help hold the left vertical molding member 20 securely against the wall 12, and also to act as a water shed. It will be appreciated that the construction of the upper right corner member 26 is a mirror image of the upper left corner member 24, and therefore will not be described.

The upper left and right corner members 24 and 26, respectively, are both secured to the wall 12 after the vertical molding members 20,22 and the mantle molding member 28 are secured to the wall 12. The upper left corner member 24 is positioned such that the interior wall portion 136 of the corner member 24 engages the channel 73 of the vertical molding member 20. A pair of threaded fasteners are then inserted through the apertures 108 and the boss portions 112 and advanced into fixed engagement with the wall 12. When assembled, the upper corner members 24 and 26 form a decorative, aesthetically appealing means to join the vertical molding members 20 and 22 with the mantle molding member 28 to produce a continuous appearing surround structure for the doorway 16. With reference to FIGS. 11 and 11A, a plastic corner plate 111 having tabs 111a is preferably included and sized to fit within the recessed area 107 and to engage behind tabs 113 shown in FIG. 9.

Referring now to FIGS. 16–19, the construction of the lower left base molding member 30 will be described. With specific reference to FIGS. 15 and 16, the base molding member 30 includes a front base portion 138 having a rectangular recessed portion 140 which includes a pair of circular recessed portions 142 each having an aperture 144. With brief reference to FIG. 19, each of the apertures 144 opens into a boss portion 146. The recessed portion 140 is also preferably covered by a cover member such as member 111 of FIG. 11A and secured via tabs such as tab 113 in FIG. 9.

With specific reference to FIG. 17, the base molding member 30 includes an upper wall 148 having a cut-out portion 150. The cut-out portion 150 includes a plurality of spaced apart, semi-circular portions 152 which are aligned so as to engage within the grooves 68 (FIG. 7) in the vertical molding member 20 when the base molding member 30 is secured to the wall 12. The base molding member 30 also includes an inner sidewall 153, and an outer side wall 154 having an inwardly protruding wall portion 156 and a flange portion 158. The inwardly protruding wall portion 156 is also shown in the side view of the right base molding member 32 in FIG. 18A. The inwardly protruding wall portion 156 engages within the channel 73 (FIG. 7) of the vertical molding member 20 to help secure the molding member 20 to the wall 12, and also to act as a water shed. It will be appreciated that the left and right base molding members 30 and 32 are constructed as mirror images of each other.

With specific reference to FIGS. 16 and 19, once the molding member 20 is secured to the wall 12, the base molding member 30 is secured to the wall 12 via a plurality of external fastening elements such as nails or threaded fasteners (not shown) which extend through the apertures 144 and the boss portions 146 (FIG. 19) to fixedly engage the wall 12.

During assembly of the apparatus 10, the flange 74 of the vertical molding member 20 is positioned behind the interior wall portion 136 (FIGS. 11 and 12) such that water is prevented from running behind the flange 76. This creates a vertically downward surface which helps to channel away water from the interior area of the vertical molding member 20.

With specific reference to FIG. 19, the interior area of the base molding member 30 could even be filled with a foam (not shown) or additional internal walls included to provide even further structural rigidity to this component. The member 30 may be manufactured from a wide-variety of techniques, but is preferably injection molded from a suitably high-strength yet lightweight plastic such as polypropylene. Alternatively, the member 30 may be molded from polystyrene to provide a component which is readily paintable or stainable.

Referring now to FIGS. 20 and 21, an optional dentil mantle component 160 is shown secured to the mantle molding member 28. The dentil mantle component 160 includes a plurality of dentil teeth 161 which even further add to the aesthetically appealing appearance of the mantle molding member 28. With reference to FIG. 21, the dentil mantle component 160 is secured to the planar support surface 90 (also shown in FIG. 8) such that a lowermost longitudinal edge portion 162 and an uppermost longitudinal edge portion 164 are held within the channels 98. In this manner, no external fastening elements are needed to secure the dentil mantle component 160 to the mantle molding member 28.

If the dentil mantle component 160 is to be included, then the component 160 is slidably inserted into the channels 98 of the mantle molding member 28 immediately after securing the mantle molding member 28 to the wall 12. The upper left and right corner members 24 and 26, respectively, may then be secured to cover the outermost left and right longitudinal ends of the component 160. Alternatively, if the overall longitudinal length of the dentil mantle component 160 is just slightly less than the longitudinal (i.e., widthwise) spacing of the corner members 24 and 26 after the corner members 24,26 are secured against the wall 12, then the dentil mantle component 160 may be secured to the mantle molding 28 by first inserting the upper longitudinal edge 164 within the upper one of the channels 98. The installer then pushes upwardly, in accordance with directional arrow 166, against several of the dentil teeth 161 to urge the lowermost longitudinal edge 162 upwardly slightly to clear a planar surface portion 168 of the molding member 28. The lowermost longitudinal edge 162 can then be urged rearwardly toward the planar support surface 90 until the edge 162 drops into the lower channel 98 adjacent the surface portion 168.

Accordingly, this arrangement provides the flexibility of enabling a dentil mantle component 160 to be added to the mantle molding member 28 even after the entire door surround apparatus has been installed. Later on, if it is desired to remove the dentil mantle component 160 and replace it with a different decorative molding component, the component 160 can be easily removed by reversing the above-described steps. The dentil mantle component 160 is preferably injection molded from polypropylene or polystyrene.

Referring now to FIG. 22, a window mantle molding assembly 170 is shown in accordance with an alternative preferred embodiment of the present invention. The window mantle molding assembly 170 is essentially identical to the mantle assembly formed by the upper left and right corner members 24,26 and the mantle molding member 28 of FIG. 1. The only difference is that the window molding assembly 170 includes only an upper left corner member 172, an upper right corner member 174 and a window mantle member 176, with the corner members 172 and 174 being slightly shorter in overall vertical height than their corresponding counterparts of the door surround apparatus 10. The corner members 172 and 174 are similarly molded, and preferably injection molded from polypropylene, but may be alternatively molded from polystyrene to provide a readily paintable or stainable surface. The window mantle member 176 is also preferably extruded from polypropylene or alternatively from polystyrene.

With brief reference to FIGS. 23 and 24, it will be noted that the upper left corner member 172 includes a bottom wall portion 178 without any cut-outs or other openings therein which would otherwise be provided if a vertical molding member is being used. It will be appreciated, however, that in some applications it may be aesthetically desirable, such as with large rectangular windows, to incorporate vertical molding members with the window mantle molding assembly 170, such as vertical molding members 20 and 22 shown in FIGS. 1–3. It will also be appreciated that an additional decorative insert member 160 could be incorporated into the window mantle molding assembly 170 in accordance with the teachings herein.

It will therefore be appreciated that the various preferred embodiments described herein provide a relatively low cost, easily constructed and easily assembled decorative molding apparatus for partially or completely surrounding either a doorway or window of a structure. The preferred embodiments further provide for controlling water run-off without the need for separate members to be installed above the doorway or window for this purpose, and also eliminate the need for caulking and to fill nail holes which are required with prior developed surround assemblies. The various preferred embodiments require less external fastening elements such as nails or threaded fasteners during assembly, thus decreasing the overall cost associated with adding a door or window surround apparatus to a doorway or window, and further easing the manner in which these surround molding assemblies may be installed.

The various preferred embodiments described herein may be installed quickly and easily without the need for special tools or extensive experience on the part of an installer. The various preferred embodiments, being manufactured from plastic, provide performance benefits over natural wood moldings in that they are not susceptible to moisture and therefore will not decay, warp or splinter. Since the various component parts of the preferred embodiments are all manufactured from high-strength, lightweight plastics, each of the components is further easily handled by a single individual during installation. The plastic construction further allows the length of the vertical molding members 20,22 the hanger members 36,52 and the mantle molding member 28 to be easily shortened by simply cutting same with a utility knife, a pair of cutting shears or a suitable saw such as a hacksaw.

Referring to FIG. 25, there is shown a vertical molding member 200 in accordance with an alternative preferred embodiment of the present invention. The molding member 200 is similar to the molding member 20 and includes a plurality of spaced apart, semi-circular decorative grooves or channels 202 and a securing portion 204 along each longitudinal edge of the member 200. Each securing portion 204 includes an enlarged lip 206 extending longitudinally along preferably a major length, and more preferably the full length, of the member 200.

Referring to FIG. 26, a vertical hanger member 208 in accordance with an alternative preferred embodiment of the present invention is illustrated. The vertical hanger member 208 includes a plurality of upstanding support portions 210 which are spaced apart such that uppermost surfaces 212 are spaced apart to rest against planar surface portions 207 (FIG. 25) of the molding member 200 when these two components are secured together. The hanger member 208 also includes a plurality of spaced apart apertures 214 formed in each lowermost support surface 216. The lowermost support surfaces 216 are positioned against the exterior surface of the building and therefore rest generally flush against the exterior surface. Threaded screws, nails or like securing fasteners are placed through the apertures 214 to secure the hanger member 208 securely to the exterior wall of the building.

It will be appreciated that the hanger member 208 also includes a channel 218 formed along one longitudinal edge. The channel 218 receives a portion of the siding after the hanger member 208 is secured to the exterior surface of the building. The overhanging edge portion 220 covers the cut edge of each strip of siding which extends into the channel 218 to produce a clean, finished looking appearance once the molding member 200 is secured to the hanger member 208.

With further reference to FIG. 26, the hanger member 208 also includes securing portions 222 integrally formed therewith. Each securing portion 222 includes a support wall 224 and a semi-circular channel portion 226. Each semi-circular channel portion 226 is sized to accept an associated one of the enlarged lips 206 of the hanger member 200. It will be appreciated that the channel portion could be formed in other shapes provided the shape selected can engage the lip portions 206 in a manner to captively secure the lip portions 206 therein.

With brief reference to FIG. 27, an alternative embodiment 227 of the hanger member of the present invention is shown. The hanger member 227 is identical to the hanger member 208 with the exception that hanger member 227 does not include the channel 218 formed along one longitudinal edge thereof. Hanger member 227 is instead adapted to be secured to buildings where the exterior surface of the building is covered by brick rather than siding. It will be noted that the upstanding support portions 210' are not as tall as those of hanger member 208. This is because with an exterior surface covered by brick, the hanger member 227 can be secured directly to the exterior surface of the brick, and therefor no additional height (as represented by the width of channel 218) is needed to clear the siding.

Referring now to FIG. 28, an installation tool 230 for securing the hanger member 208 to the exterior surface of a building is shown. The installation tool 230 is a single-piece, preferably injection molded plastic component having a slot 232 formed therein. Slot 232 is large enough to allow an individual to grasp the tool 230 by extending preferably two or more fingers through the opening 232. The tool 230 also has a plurality of spaced apart portions 234 which have an outward shape or contour to allow the spaced apart portions 234 to engage between the upstanding support portions 210 of the hanger member 208 when the tool 230 is placed over the hanger member 208. The installation tool 230 is used to hold the upstanding support portions 210 in a precise, spaced-apart orientation while nails or threaded screws are driven through the apertures 214 to secure the hanger member 208 to the exterior surface of the building. Since the hanger member 208 is quite flexible before installation, if the hanger member 208 was secured to the exterior surface without the installation tool 230 holding the hanger member 208 in a desired orientation, the hanger member 208 might be "stretched out" too much to enable the molding member 200 to be secured to the securing portions 222 (FIG. 26). Accordingly, by placing the installation tool 230 over the hanger member 208 as the hanger member 208 is secured to the exterior surface of the building, it is insured that the lowermost support surfaces 216 of the hanger member will be secured to the exterior surface of the building in a manner which will enable the molding member 200 to be easily secured to the securing portions 222. In FIG. 29, the installation tool 230 is shown positioned over the hanger member 208 to position the upstanding support portions 210 and the support walls 224 in a desired orientation which will allow the molding member 200 to be easily secured to the hanger member 208 once the installation tool 230 is removed.

FIG. 30 shows the molding member 200 secured to the hanger member 208. The enlarged lip 206 along each longitudinal end of the molding member 200 is secured within a corresponding one of the semi-circular channels 226. The molding member 200 is also supported by the uppermost surfaces 212 such that if pressure is applied against the molding member 200, the member 200 will not be able to flex but will feel solid and well supported.

Referring to FIG. 31, a mantel molding member 238 is shown in accordance with a preferred embodiment of the present invention. The mantel molding member 238 is similar to the mantel molding member 28 shown in FIG. 8 with the exception that it does not require any form of separate hanger member to aid in securing it to the exterior surface of a building or other like structure. The mantel molding member 238 includes a planar flange portion 240 having a plurality of elongated slots 242 formed therein, a channel portion 244, an upper wall surface 246, a central mounting wall portion 248 and a lowermost section 250. Also shown is an independent dentil molding insert 252 which is slidably inserted into opposing channels 254 integrally formed with and extending longitudinally along preferably the entire length of the mantel molding member 238.

With reference to FIG. 32 an installation support 256 is illustrated. The installation support 256 is formed or contoured so as to fit within a cavity 258 (FIG. 31) formed underneath the upper wall surface 246 of the mantel molding member 238 when the member 238 is secured against an exterior surface of a building wall. The installation support 256 is designed to support the upper wall surface 246 and a decorative front surface 247 (FIG. 31) when the mantel molding member 238 is secured to the exterior surface of the building. The installation support 256 is a one-piece member which is preferably injection molded from a suitably high strength plastic such as polypropylene.

With brief reference to FIG. 33, a lower installation support 260 is illustrated. Support 260 is shaped or contoured to fit within a lower cavity 262 (FIG. 31) formed just above the lowermost section 250 of the mantel molding member 238. The lower installation support 260 is also formed as a one-piece component and preferably injection molded from polypropylene or another suitably strong plastic. In FIG. 34 both of the installation supports 256 and 260 are shown in position. Preferably, a plurality of installation supports 256 are slidably inserted into the cavity 258 and spaced apart along the cavity 258 before securing the planar flange portion 240 and the central mounting wall portion 248 to the exterior surface of the building via threaded screws or nails inserted through slots 242 and 248*a*, respectively. A plurality of supports 260 are also preferably included and spaced apart along the lower cavity 262 before the mantel member 238 is secured to the exterior surface of the building.

Referring now to FIGS. 35–37, an internal corner member 266 for channeling away water collected within the channel 244 (FIG. 31) is shown. The internal corner member 266 is formed with symmetrical water channels 268 extending at a slight angle, for example, about 5°–25° from an imaginary horizontal plane away from each other. Each water channel 268 includes an upwardly extending lip 270. A mounting flange 272 is integrally formed with the channels 268 and has a plurality of spaced apart, elongated slots 274 which permit nails or threaded screws to be placed therethrough when securing the mounting flange 272 to the exterior surface of a building. The water channel 268 also includes planar wall portions 276*a* and 276*b*, with wall portion 276*a* having an angled corner portion 278 which channels water received within channel 268 downwardly away from the mounting flange 272.

In FIG. 38, the internal corner member 266 is shown in position ready to be secured against an exterior surface of a building adjacent one end of the mantel member 238. During installation, a pair of internal corner members 266 are positioned against the exterior surface of the building and secured thereto by suitable fasteners a desired distance apart, depending on the overall width of the doorway 16 (FIG. 2). The mantel member 238 is then measured and cut to a length which is preferably slightly less than the overall distance between the corner members 266, and secured against the exterior surface of the building. A corner portion 266*a* is positioned behind edge 238*a* of the mantel member 238. Edge 238*a* abuts a wall portion 280 of the internal corner member 266. Water trapped within channel 244 (FIG. 31) is able to run downwardly along water channel 268 and is directed away from the exterior surface of the building, and further away from the opening forming the doorway in the exterior wall surface. Upstanding wall portion 276*b* prevents the water from simply flowing out of channel 268 before the water is sufficiently far away from the mantle molding member 238 to ensure that the water will not enter behind the mantle molding member 238. The path of the flowing water is indicated by line 282. The overall outer dimensions of the internal corner member 266 permit it to be easily covered by a decorative corner member such as corner member 24 shown in FIG. 9. Once covered by a suitable corner member, no portion of the internal corner member 266 is visible. It will also be appreciated that since the water channels 268 are arranged symmetrically to each other, the internal corner member 266 can be rotated 180° and used at the opposite end (i.e., the left end) of the mantle molding member 238.

Referring to FIG. 39, there is shown a decorative window header member 300 in accordance with an alternative preferred embodiment of the present invention. The window header 300 is particularly well adapted to be used with new construction and/or re-siding applications where it is desired to incorporate a decorative window header over a window such as window 302 in FIG. 39. The window header 300 is also easily installed on virtually any flat exterior surface such as on brick.

With specific reference to FIG. 40, the window header assembly 300 includes an upper flange 304, a front face portion 306, a lower front face portion 308 and a lower flange 310. Between the face portions 306 and 308 is a relatively large channel or cavity 312 which includes a pair of opposing smaller channels 314. The lower flange 310 also includes a protruding flange 316. The protruding flange 316 is adapted to abut a header 318 extending horizontally above the window. A suitable number of nails or threaded fasteners are used to secure the lower flange 310 to the header 318. Likewise, a suitable number of nails or threaded fasteners are used to secure the upper flange 304 to an outer wall 320 of the dwelling or structure.

With further reference to FIGS. 40–42, positioned within the window header 300 is one or more upper installation supports 322 disposed behind the front face portion 306, and one or more lower installation supports 324 disposed in the area behind the lower front face portion 308. Installation supports 322 and 324, like supports 256 and 260 in FIGS. 32 and 33, are shaped to generally conform to the interior surfaces of the window header 300 and to provide rigidity to the window header 300 when same is installed over a window of a dwelling or other structure. Generally speaking, the supports 322 and 324 are preferably installed about every 12 inches along the length of the window header 300.

Referring further to FIG. 40, the window header 300 also preferably includes a slidably insertable decorative insert 326. The insert 326 has dimensions permitting it to extend into the channels 314 which not only helps to provide a decorative appearance to the window header 300 but also helps to impart structural rigidity thereto. As will be appreciated, the insert 326 could be provided in the style of a dentil molding or any other of a wide variety of decorative styles to help provide a unique appearance to the window header 300.

The window header 300 is preferably extruded from a high strength plastic such as polypropylene. The window header 300 enables a unique, decorative appearance to be provided adjacent the windows on the exterior surface of a building and is quickly and easily attached to the exterior surface of a building without complicated assembly plans, complicated tools or special fasteners requiring specialized tools.

Referring now to FIG. 43, a window header assembly 400 is illustrated in accordance with another alternative preferred embodiment of the present invention. The window header assembly 400 includes a header member 402 and a backplate or hanger member 404. The window header assembly 400 is particularly well adapted to be secured above a window and over vinyl or aluminum siding on the outside wall of a dwelling or structure, where the vinyl or aluminum siding has a sawtooth or otherwise uneven contour which would make securing a conventional hanger member thereto difficult. This feature will be discussed further momentarily.

With specific reference to FIGS. 43 and 44, the hanger member 404 includes an upper hook portion 406, a wall portion 408 and a lower hook portion 410. On a front surface 412 of the wall portion 408 is formed a pair of guide flanges 414 having a predetermined spacing therebetween. At least one opening 416 is formed in the wall portion 408, and preferably a series of openings 416 are performed along the length of the hanger member 404. On a back side 418 of the hanger member 404 are formed a pair of flexible depending arms 420*a* and 420*b*. The depending arms 420*a* and 420*b* preferably extend the entire length of the hanger member 404. In this manner the entire hanger member 404 can be extruded as a single piece component.

With further reference to FIG. 43, the header member 402 includes an upper J-channel 422, an upper face portion 424 and a lower face portion 426. Between the upper and lower face portions 424 and 426 is a relatively large channel 428 having a pair of opposing smaller channels 430 longitudinally in line with one another. Positioned within the channels 430 is a decorative insert member 432. The insert member 432 may have a dentil design or any other decorative design and is slidably inserted into the channels 430 during installation.

With further reference to FIG. 43, adjacent the lower face portion 426 is a lower J-channel 434. The upper and lower J-channels 422 and 434, respectively, are adapted to be engaged with hook portions 406 and 410, respectively, of the hanger member 404. When so engaged, a wall portion 436 which partially defines the channel 428 rests within the guide flanges 414. The guide flanges 414 help to provide structural rigidity to the window header assembly 400, as does the insert member 432. Wall portion 436 also includes a plurality of spaced apart, elongated openings 436*a*, the function of which will be described momentarily.

Referring to FIG. 45, it is an important advantage of the window header assembly 400 that the hanger member 404 is able to be positioned against siding 438 on the outer surface of a building 440 and to make contact with the siding 438 at least at two points. This contact is provided by the flexible depending arms 420*a* and 420*b*, which are able to flex slightly when the outer surface 418 of the hanger member 404 is positioned against the siding 438. Without the flexible depending arms 420*a* and 420*b*, in many instances it would not be possible to position the window header assembly 400 such that same is generally perpendicular to the ground. Put differently, in many instances, securing the outer surface 418 of the hanger member 404 directly to the siding would result in the hanger member 404 being tilted or angled slightly such that same is not generally parallel to the siding 438. With the hanger member 404, preferably one or a plurality of nails or suitably long threaded fasteners 442 are incorporated at spaced apart locations along the wall portion 412 to secure the hanger member 404 to the outer surface 440 of the dwelling or structure. The arm portions 420*a* and 420*b*, being flexible, flex as needed to provide at least two points of contact against the siding 438, and in some instances even three points of contact. Most importantly, the arm portions 420*a* and 420*b* enable the hanger member 404 to be secured relative to the siding 438 such that it extends generally parallel to the siding 438 and generally perpendicular to the ground. If one or the other of the flexible arms 420*a* and 420*b* are too long such that the hanger member is not resting generally parallel to the siding 438, then one or the other of the arms 420*a* or 420*b* can be cut with a utility knife.

With further reference to FIG. 45, optionally, but preferably, a plurality of upper installation supports 444 and a plurality of lower installation supports 446 are included to provide further structural rigidity to the window header assembly 400 when same is installed. The window header assembly 400 is preferably installed by first assembling the hanger member 404 to the header member 402. This involves sliding the installation supports into the areas behind the face portions 424 and 426, respectively, of the header member 402. The upper and lower J-channels 422 and 434 are then slid onto the hook portions 406 and 410, respectively. Wall portion 436 will then be resting within the guide flanges 414. No threaded external fasteners are required to attach the header member 402 to the hanger member 404. The assembly 400 is then placed as desired against the siding 438 with the insert member 432 removed. External fasteners can then be inserted through the elongated openings 436*a* in the wall portion 436 and through openings 416 to secure the assembly 400 to the siding 438. Lastly, the decorative insert member 432 is slidably inserted within the channels 430.

Each of the embodiments of FIGS. 39 and 43 could also be used with the internal corner member illustrated in FIG. 38, as well as the corner members 172 in FIG. 22. It will be appreciated immediately, however, that the window header assembly 400 could be secured with little or no modification above a doorway to form part of a door surround in the event siding extends over the doorway. Thus, the window header assembly 400 is not limited to just installations involving windows.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A decorative window header molding assembly adapted to be secured to non-planar siding on an exterior surface of a structure, said assembly comprising:

a decorative header member having at least one first securing portion;

a hanger member having a wall portion, said wall portion having a rear surface having a flexible depending arm portion projecting therefrom and a second securing portion, said flexible depending arm portion having a length sufficient to abuttingly engage said siding when said hanger member is secured to said siding such that said rear surface of said hanger member contacts said siding at two spaced apart locations to support said hanger member generally flush against and parallel to said siding; and said first securing portion of said header member being engageable with said second securing portion of said hanger member to substantially surround and conceal said hanger member and to secure said header member to said hanger member without external fastening.

2. The assembly of claim 1, further comprising an upper installation support member having dimensions permitting it to be slidably inserted behind a portion of said header member to provide structural support to said header member.

3. The assembly of claim 1, further comprising a lower installation member adapted to be inserted within a portion of said decorative header member to provide structural rigidity to said decorative header member.

4. The assembly of claim 1, wherein said hanger member includes a pair of said flexible depending arm portions depending from said rear surface of said wall portion.

5. The assembly of claim 1, wherein said hanger member comprises a pair of spaced apart guide flanges adapted to receive a portion of said decorative header member when said decorative header member is secured to said hanger member.

6. The assembly of claim 1, further comprising a pair of said first securing portions, one of said first securing portions being disposed at an upper end of said header member and a second one of said pair of securing portions being disposed at a lower end of said header member.

7. The assembly of claim 6, wherein each of said first securing portions form a J-channel.

8. The assembly of claim 1, wherein said header member further comprises a pair of opposing channels formed in a generally common vertical plane; and an insert member adapted to be slidably inserted into said opposing channels.

9. The assembly of claim 1, wherein said hanger member comprises a plurality of apertures for enabling said hanger member to be secured to an exterior surface of said structure.

10. The assembly of claim 1, wherein said hanger member is one piece.

11. A hanger member for supporting a decorative molding member adjacent an outer surface of a dwelling over a window or doorway of said dwelling, said hanger member comprising: a generally planar wall portion having front and rear surfaces; at least one securing portion integrally formed with said wall portion and adapted to receive said molding member to conceal said front surface; a flexible depending arm portion depending outwardly from said rear surface and integrally formed therewith said flexible arm portion adapted to engage said outer surface of said dwelling.

12. The apparatus of claim 11, further comprising a pair of said securing portions disposed at opposite ends of said wall portion for securing said molding member to said wall portion.

13. The apparatus of claim 12, wherein said pair of securing portions each comprises a J-channel adapted to engage with an associated portion of said molding member.

14. The apparatus of claim 11, wherein said wall portion further comprises a pair of longitudinally extending, spaced apart guide flanges for receiving a portion of said molding member when said molding member is secured to said hanger member.

15. The apparatus of claim 11, wherein said apparatus includes a pair of said flexible depending arm portions extending outwardly of said rear surface of said wall portion; and wherein said flexible depending arm portions are formed so as to diverge from one another from said rear surface.

16. A decorative mantle member adapted to be placed over a window or doorway of a structure before securing siding or other like decorative surface to said structure, said apparatus comprising an upper flange; a face portion having an upper face portion and a lower face portion and a channel formed therebetween said channel comprising first and second opposing secondary channels adapted to receive a decorative insert member; a lower flange adapted to extend inwardly underneath a header member of said structure when said upper flange is placed against an outer wall of said structure; said lower flange including an edge and a protruding flange depending upwardly from said lower flange and spaced apart from said edge adapted to abut said header of said structure to help align said mantle member on said outer surface of said structure prior to securing said mantle member to said structure; said lower flange securable via an external fastening element to said header member; and said upper flange securable to said outer surface of said structure by an external fastening member.

* * * * *